US011344941B2

(12) United States Patent
Yamano et al.

(10) Patent No.: US 11,344,941 B2
(45) **Date of Patent: *May 31, 2022**

(54) METHOD OF MANUFACTURING HOT-PRESS-FORMED STEEL MEMBER

(75) Inventors: Takayuki Yamano, Kakogawa (JP); Jiro Iwaya, Kakogawa (JP); Noriyuki Jimbo, Kakogawa (JP); Tatsuya Asai, Kakogawa (JP); Naoki Mizuta, Kakogawa (JP)

(73) Assignee: Kobe Steel, Ltd., Kobe (JP)

( * ) Notice: Subject to any disclaimer, the term of this patent is extended or adjusted under 35 U.S.C. 154(b) by 691 days.

This patent is subject to a terminal disclaimer.

(21) Appl. No.: 14/233,617

(22) PCT Filed: Jul. 18, 2012

(86) PCT No.: PCT/JP2012/068211

§ 371 (c)(1),
(2), (4) Date: Feb. 7, 2014

(87) PCT Pub. No.: WO2013/012006

PCT Pub. Date: Jan. 24, 2013

(65) Prior Publication Data

US 2014/0144560 A1 May 29, 2014

(30) Foreign Application Priority Data

Jul. 21, 2011 (JP) ..... JP2011-160090
Jan. 26, 2012 (JP) ..... JP2012-014656

(51) Int. Cl.
*B21D 22/02* (2006.01)
*C22C 38/00* (2006.01)
(Continued)

(52) U.S. Cl.
CPC ..... *B21D 22/022* (2013.01); *B21D 22/208* (2013.01); *C21D 1/673* (2013.01);
(Continued)

(58) Field of Classification Search
None
See application file for complete search history.

(56) References Cited

U.S. PATENT DOCUMENTS 6,645,320 B2 11/2003 Asai et al.
2005/0150580 A1 7/2005 Akamizu et al.
(Continued)

FOREIGN PATENT DOCUMENTS

CN 101275200 A 10/2008
EP 1 553 202 A1 7/2005
(Continued)

OTHER PUBLICATIONS

JP 2006-213959 written English translation of Table 2.*
(Continued)

*Primary Examiner* — Paul A Wartalowicz
*Assistant Examiner* — Stephani Hill
(74) *Attorney, Agent, or Firm* — Oblon, McClelland, Maier & Neustadt, L.L.P.

(57) ABSTRACT

In a method for obtaining a hot-press-formed steel member, a steel sheet containing 0.10-0.30 mass % of C, 1.0-2.5 mass % of Si, 1.0-3.0 mass % of Si and Al in total, and 1.5-3.0 mass % of Mn is heated at a heating temperature of not less than the $Ac_3$ transformation point. The steel sheet is hot-press formed for one or more times. The starting temperature of the hot pressing is not more than the heating temperature but not less than the Ms point. The average cooling rate from (Ms point−150)° C. to 40° C. is 5° C./s or less. The hot-press-formed steel member has high strength, high tensile elongation, high bendability, excellent deformation characteristics at the time of collision crush, and excellent delayed fracture resistance.

17 Claims, 25 Drawing Sheets

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/14*** | (2006.01) |
| ***C22C 38/28*** | (2006.01) |
| ***C22C 38/34*** | (2006.01) |
| ***C22C 38/38*** | (2006.01) |
| ***C22C 38/42*** | (2006.01) |
| ***C22C 38/50*** | (2006.01) |
| ***C22C 38/54*** | (2006.01) |
| ***C22C 38/30*** | (2006.01) |
| ***C21D 1/673*** | (2006.01) |
| ***B21D 22/20*** | (2006.01) |
| ***C22C 38/58*** | (2006.01) |
| ***C21D 8/02*** | (2006.01) |
| ***C22C 38/32*** | (2006.01) |

(52) U.S. Cl.

CPC ..... *C21D 8/0247* (2013.01); *C22C 38/001* (2013.01); *C22C 38/002* (2013.01); *C22C 38/02* (2013.01); *C22C 38/04* (2013.01); *C22C 38/06* (2013.01); *C22C 38/14* (2013.01); *C22C 38/28* (2013.01); *C22C 38/30* (2013.01); *C22C 38/32* (2013.01); *C22C 38/34* (2013.01); *C22C 38/38* (2013.01); *C22C 38/42* (2013.01); *C22C 38/50* (2013.01); *C22C 38/54* (2013.01); *C22C 38/58* (2013.01); *C21D 2211/002* (2013.01); *C21D 2211/008* (2013.01)

(56) References Cited

U.S. PATENT DOCUMENTS

| | | | | |
|---|---|---|---|---|
| 2005/0257862 | A1 | 11/2005 | Asai et al. | |
| 2006/0185774 | A1* | 8/2006 | Nishihata | C22C 38/28 148/653 |
| 2009/0007999 | A1 | 1/2009 | Asai | |
| 2011/0182765 | A1 | 7/2011 | Giefers et al. | |
| 2011/0226393 | A1* | 9/2011 | Senuma | C22C 38/04 148/645 |
| 2013/0017411 | A1 | 1/2013 | Hamada et al. | |
| 2013/0048161 | A1 | 2/2013 | Matsuda et al. | |
| 2013/0153096 | A1 | 6/2013 | Hamada et al. | |
| 2013/0192726 | A1* | 8/2013 | Chen | C22C 38/14 148/654 |
| 2013/0236350 | A1 | 9/2013 | Kakiuchi et al. | |
| 2013/0259734 | A1 | 10/2013 | Kakiuchi et al. | |
| 2013/0263637 | A1 | 10/2013 | Yamano et al. | |
| 2013/0273391 | A1 | 10/2013 | Hamada et al. | |
| 2013/0330226 | A1 | 12/2013 | Murakami et al. | |
| 2014/0096876 | A1 | 4/2014 | Matsuda et al. | |

FOREIGN PATENT DOCUMENTS

| | | | | |
|---|---|---|---|---|
| EP | 2 341 156 | A1 * | 7/2011 | |
| EP | 2 546 375 | A1 | 1/2013 | |
| JP | 2005-152969 | A | 6/2005 | |
| JP | 2005152969 | A * | 6/2005 | |
| JP | 2006 212663 | | 8/2006 | |
| JP | 2006 213959 | | 8/2006 | |
| JP | 2010043323 | A * | 2/2010 | |
| JP | 2010-65292 | * | 3/2010 | |
| JP | 2010-65293 | * | 3/2010 | |
| JP | 2010 70806 | | 4/2010 | |
| JP | 2010-126770 | * | 6/2010 | |
| JP | 2010 174280 | | 8/2010 | |
| JP | 2010-174280 | A | 8/2010 | |
| JP | 2010174281 | A * | 8/2010 | |
| JP | 2011 184758 | | 9/2011 | |
| JP | WO 2011111333 | A1 * | 9/2011 | C21D 1/22 |
| JP | 2012-41613 | * | 3/2012 | |
| WO | WO-2010032776 | A1 * | 3/2010 | C22C 38/04 |
| WO | WO-2012048841 | A1 * | 4/2012 | C22C 38/12 |

OTHER PUBLICATIONS

WO 2011/111333 machine translation.*
D. W. Fan. B. C. De Cooman. "State-of-the-knowledge on coating systems for hot stamped parts." Steel Research Int. 83 (2012) No. 5 pp. 412-433.*
Clarke et al. Scripta Materialia 61 (2009) 149-152 (Year: 2009).*
Liu et al. Scripta Materialia 64 (2011) 749-752 (Year: 2011).*
JP 2005-152969 machine translation (Year: 2005).*
JP 2010-174281 machine translation (Year: 2010).*
Bramfitt. "Effects of composition, processing, and structure on properties of irons and steels." ASM Handbook, vol. 20: Materials Selection and Design. ASM International 1997, p. 357-382. (Year: 1997).*
JP2005-152969 written English translation of [0006] (Year: 2005).*
JP 2010-043323 machine translation (Year: 2010).*
U.S. Appl. No. 11/116,304, filed Apr. 28, 2005, US2005/0257862 A1, Asai, et al.
U.S. Appl. No. 11/908,412, filed Sep. 12, 2007, US2009/0007999 A1, Asai.
U.S. Appl. No. 13/635,768, filed Sep. 18, 2012, US2013/0017411 A1, Hamada, et al.
U.S. Appl. No. 13/690,552, filed Nov. 30, 2012, US2013/0153096 A1, Hamada, et al.
U.S. Appl. No. 13/800,561, filed Mar. 13, 2013, US2013/0273391 A1, Hamada, et al.
U.S. Appl. No. 13/988,210, filed Jun. 17, 2013, US2013/0259734 A1, Kakiuchi, et al.
U.S. Appl. No. 13/988,382, filed May 20, 2013, US2013/0236350 A1, Kakiuchi, et al.
U.S. Appl. No. 13/995,009, filed Jun. 17, 2013, US2013/0263637 A1, Yamano, et al.
U.S. Appl. No. 14/001,819, filed Aug. 27, 2013, US2013/0330226 A1, Murakami, et al.
Extended European Search Report dated Feb. 17, 2016 in European Patent Application No. 15002647.4.
Extended European Search Report dated May 7, 2015 in Patent Application No. 12814192.6.
Written Opinion of the International Searching Authority dated Sep. 4, 2012 in PCT/JP12/068211 Filed Jul. 18, 2012.
International Search Report dated Sep. 4, 2012 in PCT/JP12/068211 Filed Jul. 18, 2012.

* cited by examiner (a)

EXAMPLE WITHOUT REINFORCING COMPONENT (b)

EXAMPLE WITH REINFORCING COMPONENT

METHOD OF MANUFACTURING HOT-PRESS-FORMED STEEL MEMBER

TECHNICAL FIELD

The present invention generally relates to a method of manufacturing a hot-press-formed steel member, in which a steel sheet (hereinafter, also referred to as "blank") as a material of the member is heated to an austenite transformation point ($Ac_3$ transformation point) or higher, and is then hot press formed (forming) in a field of manufacturing a formed article of sheet steel mainly used for automotive bodies, and particularly relates to a method of manufacturing a steel member that exhibits high strength and particularly has excellent ductility.

BACKGROUND ART

Automotive steel components have been progressively increased in strength of materials thereof in order to achieve excellent collision safety despite lightweight. In addition, high workability is required for steel sheets to be used for manufacturing such components. However, in the case where a steel sheet having an increased strength, particularly a steel sheet having a tensile strength of 980 MPa or more, is subjected to cold working (for example, cold press forming), an increase in forming load of press working and/or extreme degradation in dimension accuracy are disadvantageously caused.

A measure to solve such problems includes a hot press forming technique in which a steel sheet as a material is press-formed while being heated so that the steel sheet is increased in strength while being formed. In this measure, a steel sheet at high temperature is formed with a tool (a punch and a die), during which the steel sheet is held and cooled at a bottom dead center (of forming), thereby the steel sheet is rapidly cooled through heat removal from the steel sheet to the tool for quenching of the material. Such a forming process achieves a formed article having excellent dimension accuracy and high strength, and reduces a forming load compared with a case where a component in the same strength class is formed in cold working.

In such a measure, however, the steel sheet must be held for a certain time at the bottom dead center, which results in long occupation of a press forming machine for manufacturing of one steel member, thus leading to low productivity.

In addition, hot press forming is substantially one-time working, and is therefore limited in formable shapes. Moreover, since the resultant steel member has high strength, it is difficult to perform post working such as cutting and punching on the steel member.

Thus, various investigations have been made on hot press forming techniques in order to improve productivity and increase the degree of forming freedom.

For example, PTL1 discloses that a steel sheet, to which an element that lowers the $Ar_3$ point such as Mn, Cu, or Ni is added, is used as a material so that ferrite is not precipitated during press forming, thus allowing two or more times of successive press forming in hot press forming while certain strength of the formed member is secured.

PTL2 discloses that a hot-rolled steel sheet having a microstructure mainly containing a bainite phase, in which prior austenite grains have an average particle size of 15 μm or less, is used for forming, and the steel sheet is subjected to predetermined hot press forming to produce a hot press formed member having prior austenite grains having an average particle size of 8 μm or less, thereby allowing ductility of the member to be secured.

PTL3 discloses that a blank heating condition for hot press forming is set to rapid heating and short holing, in detail, the blank heating condition includes a heating step of heating to a maximum heating temperature T° C. of 675 to 950° C. at a heating rate of 10° C./sec or more, a temperature holding step of holding the maximum heating temperature T° C. for (40-T/25) sec or less, and a cooling step of cooling from the maximum heating temperature T° C. to a Ms point as a formation temperature of a martensite phase at a cooling rate of 1.0° C./sec or more, thereby coarsening of austenite can be prevented, and the martensite phase of the member has an average particle size of 5 μm or less, thus allowing toughness (ductility) of the member to be secured.

PTL4 discloses that a large amount of hardenable element (Mn, Cr, Cu, or Ni) is added to a material to be hot press formed, which allows holding at a bottom dead center in a press forming tool to be omitted, leading to improvement in productivity.

Any of such techniques does not necessarily require holding at the bottom dead center, which promisingly improves productivity, but does not investigate higher ductility, deformation characteristics in collision collapse (hereinafter, the characteristics are also referred to as "crashworthiness"), and delayed fracture resistance as described below.

Specifically, in PTL1, since the cooling rate is increased to the utmost after completion of press forming, higher ductility is less likely to be achieved. Furthermore, in each of PTL1 and PTL4, a material (blank) contains a large amount of an alloy element to secure strength; hence, ductility is less likely to be secured.

In addition, when a member is increased in strength, delayed fracture may occur, but any of PTL1 to PTL4 does not focus delayed fracture resistance. Furthermore, when then member is used for an automotive component, crashworthiness must be considered, but none of PTL1 to PTL4 focuses on the crashworthiness.

CITATION LIST

Patent Literature

PTL1: Japanese Unexamined Patent Application Publication No. 2006-212663.
PTL2: Japanese Unexamined Patent Application Publication No. 2010-174280.
PTL3: Japanese Unexamined Patent Application Publication No. 2010-70806.
PTL4: Japanese Unexamined Patent Application Publication No. 2006-213959.

SUMMARY OF THE INVENTION

Problems that the Invention is to Solve

An object of the present invention, which has been made in light of the above-described circumstances, is to establish a technique for manufacturing a hot-press-formed steel member, which exhibits high strength (1100 MPa or more, preferably 1300 MPa or more, and more preferably 1500 MPa or more), excellent tensile elongation (ductility), and excellent bendability, and secures excellent deformation characteristics in collision collapse (crashworthiness) and excellent delayed fracture resistance, by an efficient process having a high degree of freedom of a forming shape.

Means for Solving the Problems

A method of manufacturing a hot-press-formed steel member of the present invention that allows the above-described problem to be solved, the steel member being manufactured by heating of a steel sheet having a chemical composition satisfying C: 0.10 to 0.30% (by mass percent, the same holds true for other chemical components), Si: 1.0 to 2.5%, Si+Al: 1.0 to 3.0% in total, and Mn: 1.5 to 3.0%, the remainder consisting of iron and inevitable impurities, and by one or more times of hot press forming of the steel sheet, is characterized in that the heating temperature is an $Ac_3$ transformation point or higher, start temperature of the hot press forming is the heating temperature or lower and a Ms point or higher, and an average cooling rate from (Ms point−150)° C. to 40° C. is 5° C./sec or less.

In the hot press forming, finish temperature of final hot press forming may be the Ms point or lower and (Ms point−150)° C. or higher.

The steel sheet for use in the manufacturing method may further contain (a) Cr: 1% or less (not including 0%), (b) Ti: 0.10% or less (not including 0%), (c) B: 0.005% or less (not including 0%), (d) Ni and/or Cu: 0.5% or less (not including 0%), (e) Mo: 1% or less (not including 0%), and (f) Nb: 0.05% or less (not including 0%).

The present invention further includes a hot-press-formed steel member produced by the above-described manufacturing method, the hot-press-formed steel member being characterized by having a steel microstructure that contains 2 vol % or more of retained austenite.

The present invention further includes a steel sheet to be hot press formed for use in the manufacturing method, the steel sheet being characterized by satisfying C: 0.10 to 0.30%, Si: 1.0 to 2.5%, Si+Al: 1.50 to 3.0% in total, and Mn: 1.5 to 3.0%, the remainder consisting of iron and inevitable impurities.

The steel sheet may further contain (a) Cr: 1% or less (not including 0%), (b) Ti: 0.10% or less (not including 0%), (c) B: 0.005% or less (not including 0%), (d) Ni and/or Cu: 0.5% or less in total (not including 0%), (e) Mo: 1% or less (not including 0%), or (f) Nb: 0.05% or less (not including 0%).

The present invention further includes an automotive steel component produced by performing working on the above-described hot-press-formed steel member.

Advantageous Effects of the Invention

According to the present invention, the steel member subjected to hot press forming exhibits high strength, and has excellent tensile elongation ductility and excellent bendability; hence, the steel component can secure excellent deformation characteristics in collision collapse (crashworthiness), and is thus preferable for automotive high strength steel components. Furthermore, the steel member has excellent delayed fracture resistance. Hence, even if the steel member, which has had high strength through hot press forming, is further subjected to post-working such as punching, the member exhibits excellent delayed fracture resistance at such a worked site.

In addition, the steel member is not held at the bottom dead center unlike hot stamping in the past. Hence, the steel member can be efficiently manufactured. Furthermore, a plurality of times of hot press forming can be performed, leading to a high degree of freedom of a formable shape.

Furthermore, a forming load of press working can be reduced, and dimension accuracy is excellent compared with cold press forming working, and material damage (work hardening) is small compared with a steel member manufactured by cold press forming. Hence, ductility (for example, bendability) of a steel component is better than that of a cold-press-formed member. When an automotive steel member is deformed to be bent due to collision, the steel member can advantageously absorb a large amount of energy compared with the cold-press-formed member despite having the same strength (i.e., the steel member can be bent to a smaller radius, and has a larger deformation power). In addition, since the steel member is formed in hot working, residual stress after forming can be reduced, and thus delayed fracture is less likely to occur.

MODE FOR CARRYING OUT THE INVENTION

Figure 1:
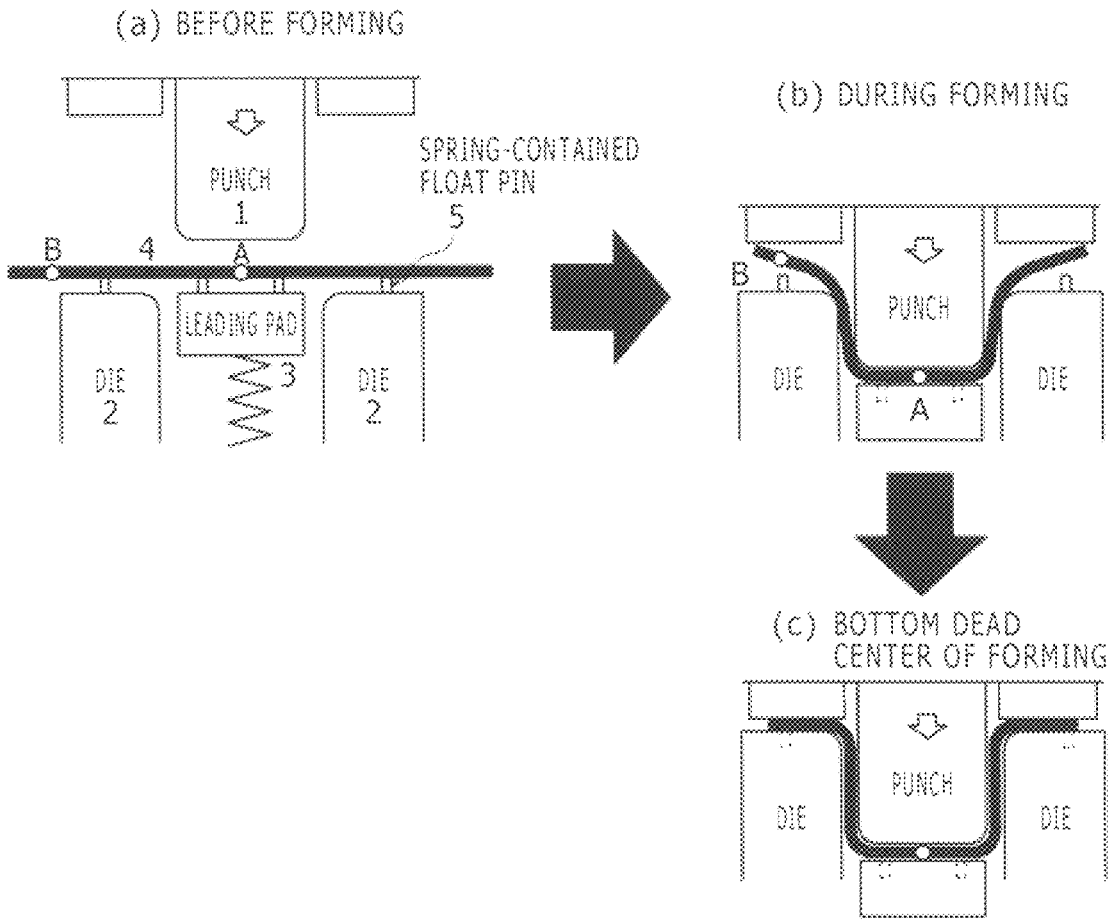
FIG. 1 includes diagrams illustrating press forming (hot press forming or cold press forming) steps in an Example.

The inventors have made studies to achieve a member having the above-described characteristics. As a result, as described below, they have got the following findings. In a method of manufacturing a steel member, a steel sheet (blank) having a higher Si content than that of a hot stamping steel sheet in the past is prepared, and the steel sheet is heated and subjected to hot press forming one or more times. In particular, when temperature during the heating (heating temperature) is an $Ac_3$ transformation point or more, start temperature of the hot press forming is the heating temperature or lower and a Ms point or higher, and an average cooling rate from (Ms point−150)° C. to 40° C. is 5° C./sec or less, a high-strength hot-press-formed steel member is obtained, which exhibits high strength, and contains a certain amount or more of retained austenite (retained γ), and thus exhibits high tensile elongation (ductility) and bendability, secures excellent deformation characteristics in collision collapse (crashworthiness), and secures excellent delayed fracture resistance. Consequently, they have completed the present invention.

The reason for specifying the manufacturing condition in the present invention is now described in detail.

[Manufacturing Condition]

In the manufacturing method of the present invention, a steel member is manufactured by preparing a steel sheet described later, heating the steel sheet, and performing hot press forming on the steel sheet one or more times. The method satisfies the following requirements.

[Heating at Temperature (Heating Temperature) of $Ac_3$ Transformation Point or More]

The steel sheet is heated at an $Ac_3$ transformation point (austenite transformation point, hereinafter, also referred to as "$Ac_3$ point") or more, thereby a microstructure described later is readily produced, and thus the steel member has desired characteristics. In contrast, in any of Examples 2 to 6 in PTL3, while the $Ac_3$ transformation point of a used steel sheet is higher than 800° C., maximum achieving temperature T is 800° C., i.e., the steel sheet is not heated at a temperature of the $Ac_3$ transformation point or more. In Example 1 in PTL3, while experiments are performed with the maximum achieving temperature T being varied between 650 to 1000° C., such experiments are performed at 700° C. and 775° C. lower than the $Ac_3$ transformation point in some cases. If the heating temperature is lower than the $Ac_3$ transformation point in this way, ferrite, etc. remains; hence, even if a cooling rate after heating is controlled, high strength may be extremely difficult to be secured.

The heating temperature is preferably ($Ac_3$ point+10)° C. or higher. If the heating temperature is extremely high, a microstructure composing the steel member is coarsened, which may cause reduction in ductility and bendability; hence, the upper limit of the heating temperature is about ($Ac_3$ point+100)° C.

Heating time of the heating temperature is preferably one minute or more. The heating time is preferably 15 min or less in light of suppressing grain growth of austenite, for example. Any heating rate is acceptable up to the $Ac_3$ transformation point.

The atmosphere during the heating may be an oxidizing atmosphere, a reducing atmosphere, or a non-oxidizing atmosphere. Specifically, examples of the atmosphere include an air atmosphere, a combustion gas atmosphere, and a nitrogen gas atmosphere.

[Start Temperature of Hot Press Forming: The Heating Temperature or Lower and Ms Point or Higher]

The start temperature of the hot press forming is specified to be the heating temperature or lower and the Ms point or higher, thereby allowing working to be easily performed, and allowing a forming load of press working to be sufficiently reduced. The start temperature of the hot press forming is preferably (Ms point+30)° C. or more, and more preferably (Ms point+50)° C. or more.

In the present invention, start of hot press forming refers to timing at which part of a blank is first contacted to a tool in first forming, and finish of hot press forming refers to timing at which all sites of a formed article are separated from the tool in final forming.

In the present invention, although the start temperature of hot press forming (i.e., temperature of a blank at the timing where part of the blank is first contacted to a tool in first forming) is specified, finish temperature of hot press forming (i.e., temperature of the blank at the timing where all sites of a formed article are separated from the tool in final forming) is not specified (the finish temperature of hot press forming is described in detail below).

The hot press forming may be performed one time or plural times. The hot press forming is performed plural times, thereby allowing a member having a complicated shape to be formed, and allowing dimension accuracy to be improved. The dimension accuracy is achieved according to the following mechanism.

In a press forming process, a blank is contacted to a tool at various sites for different periods, which may cause temperature difference (unevenness) within a formed article. For example, in the case of bending forming as illustrated in FIG. 1, a portion A of a blank in FIG. 1 shows a large decrease in temperature (large amount of heat removal to a tool) due to long contact time to the tool, while a portion B of the blank in FIG. 1 shows a small decrease in temperature due to short contact time to the tool. Such differences in decrease in temperature cause differences in thermal contraction within a formed article, which induces thermal deformation (plastic deformation), leading to degradation in dimension accuracy of the formed article.

In contrast, when multistage forming, i.e., a plurality of times of press forming working are performed at the Ms point or higher, and even if degradation in dimension accuracy occurs in a prior step, since subsequent forming is still performed at high temperature, such degradation in dimension accuracy can be readily corrected. Furthermore, repeated forming eliminates unevenness in temperature depending on sites; hence, degradation in dimension accuracy due to unevenness in temperature is also easily resolved.

Furthermore, such multistage hot press forming allows correction step with shape constraint to be added, thus allowing dimension accuracy as an issue of multistage hot press forming to be improved. While dimension accuracy is disadvantageously degraded in a hot forming step with productivity-conscious multistage forming, the dimension accuracy is remarkably improved by performing tool release at the Ms point or lower in final hot press forming (including one-time hot press forming) (i.e., by setting finish temperature of final hot press forming to the Ms point or lower). Furthermore, if the contact state to the tool (tool constraint) can be maintained to (Ms point−150)° C., such an effect is further stably exhibited. This is particularly effective for a member produced using a blank having a small thickness of, for example, 1.4 mm or less since degradation in dimension accuracy is large in multistage forming in the case of such a member.

For plural times of hot press forming, a forming process includes plural times of forming with one tool, and plural times of forming with a plurality of tools having different shapes, i.e., plural times of forming with tools the shapes of which are different for each of the successive forming operations (steps).

The multistage forming allows working amount per step for ultimately needed working amount to be reduced, thus allowing forming of a member having a more complicated shape.

Figure 2:
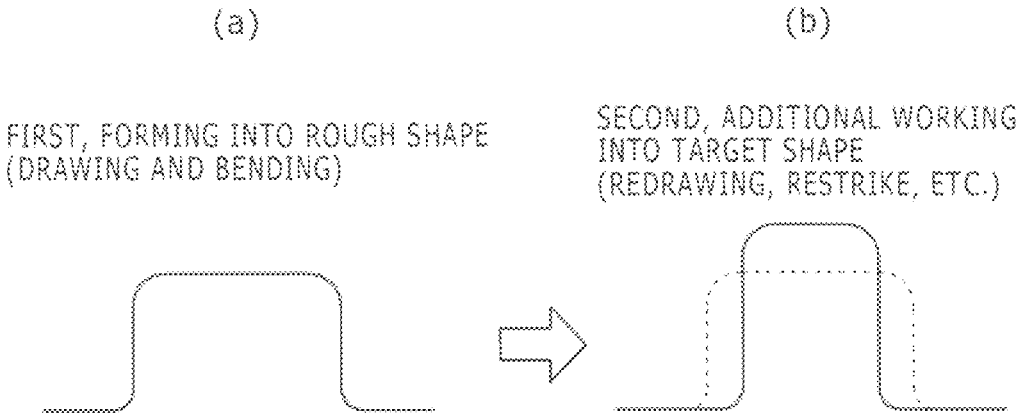
FIG. 2 includes schematic illustrations of a multistage forming process.

For example, while a component such as a rear-side member is three-dimensionally curved, and has a cross-sectional shape (width and height) that varies in a longitudinal direction, such a component is generally difficult to be formed into a final shape in one step. However, the component having a complicated shape can be produced by a multistage forming process (with a plurality of steps) as illustrated in FIG. 2. Specifically, the component can be formed through step distribution, in which, for example, a blank is formed (drown and bent) into a rough shape as illustrated in FIG. 2(*a*) in a first step, and is then subjected to additional working (such as redrawing and restrike) into a final shape as illustrated by a solid line in FIG. 2(*b*) in a second step.

Figure 3:
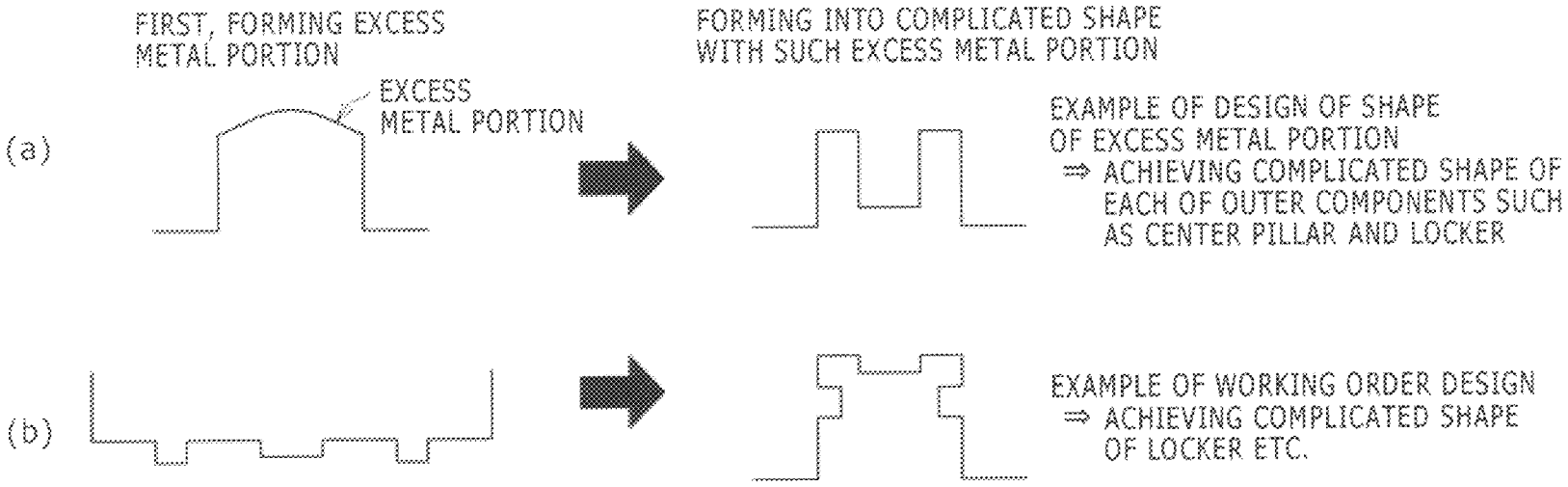
FIG. 3 includes illustrations each illustrating an exemplary multistage forming process.

Furthermore, a resultant shape in each of first and second steps in a multistage forming process is appropriately designed (through appropriate formation of an excess metal portion, appropriate setting of order of working operations, etc.), thereby allowing formation of a remarkably complicated shape as illustrated in of FIGS. 3(*a*) and 3(*b*). Formation of such a complicated shape is achieved, which in turn allows higher performance (such as improvement in stiffness and in crashworthiness) of a component and reduction in thickness thereof to be achieved.

Figure 4:
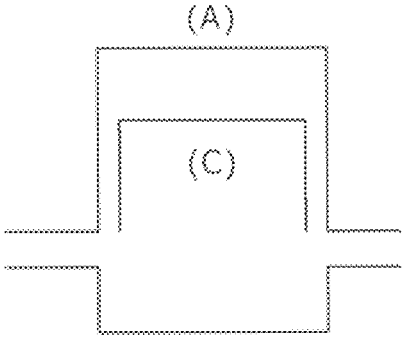
FIG. 4 is a cross section diagram of a steel component having a reinforcing component.

In actual automotive body structure, as illustrated in FIG. 4 (cross section diagram), a component (A) having a reinforcing component (C) (for example, a center pillar and a locker) in its inside is often used. If the component (A) having such a shape receives an impact, a sectional shape thereof is less likely to be collapsed (as described in detail in Example 5 later), thus allowing crashworthiness to be improved. If the component (A) can be formed into a complicated shape, the component (A) itself can be improved in crashworthiness. As a result, the reinforcing component (C) can be omitted or reduced in thickness, thus achieving lightweight and cost reduction.

Figure 5:
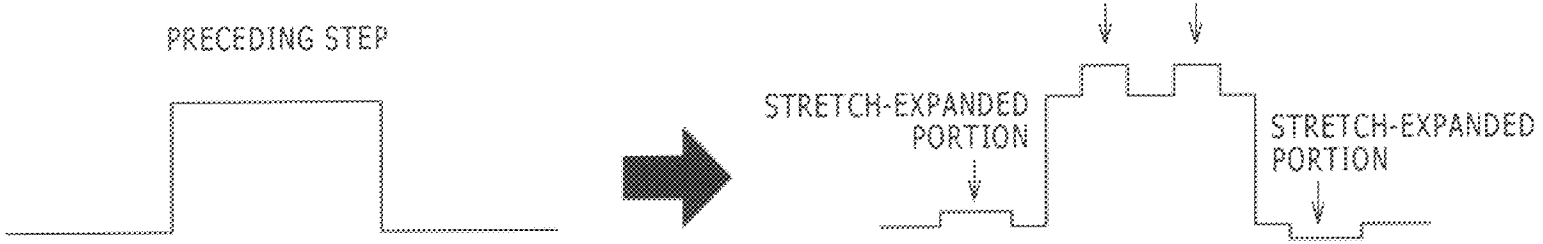
FIG. 5 is a schematic illustration illustrating an example of stretch-expand forming in a multistage forming process.
Figure 6:
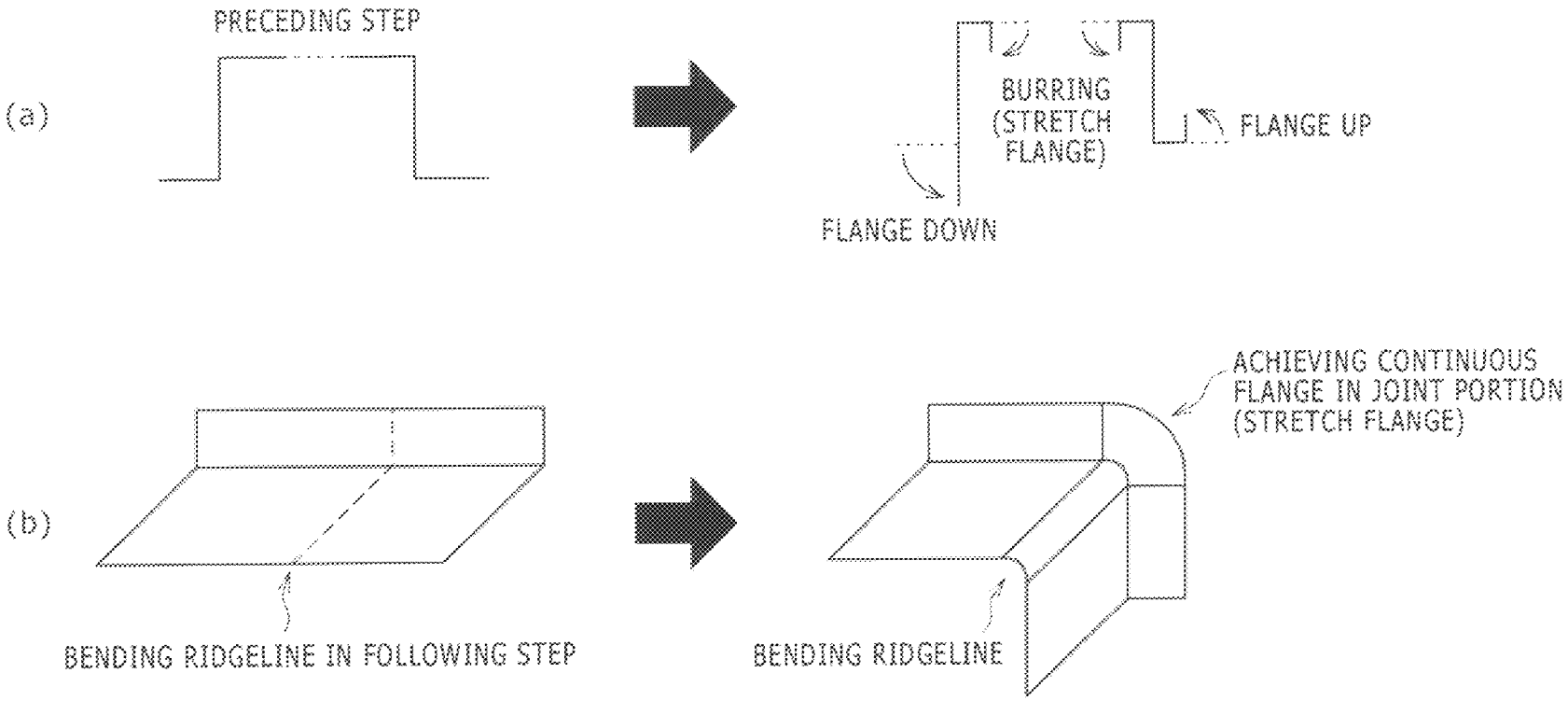
FIG. 6 includes schematic illustrations each illustrating an example of flange forming in a multistage forming process.

Examples of the multistage forming include stretch-expand forming or flange forming in a second step or later as described below. For example, as illustrated in FIG. 5, stretch-expand forming is performed in a second step or later of a multistage forming process. The stretch-expand shape is added by the stretch-expand forming, thus allowing higher performance (such as improvement in stiffness and in crashworthiness) of a steel component to be achieved. Furthermore, for example, as illustrated in FIGS. 6(*a*) and 6(*b*), flange forming (such as flange up, flange down, stretch flange, burring, and shrink flange) is performed in a second step or later of the multistage forming process. Such flange forming also allows higher performance (such as improvement in stiffness and in crashworthiness) of a steel member to be achieved.

Figure 7:
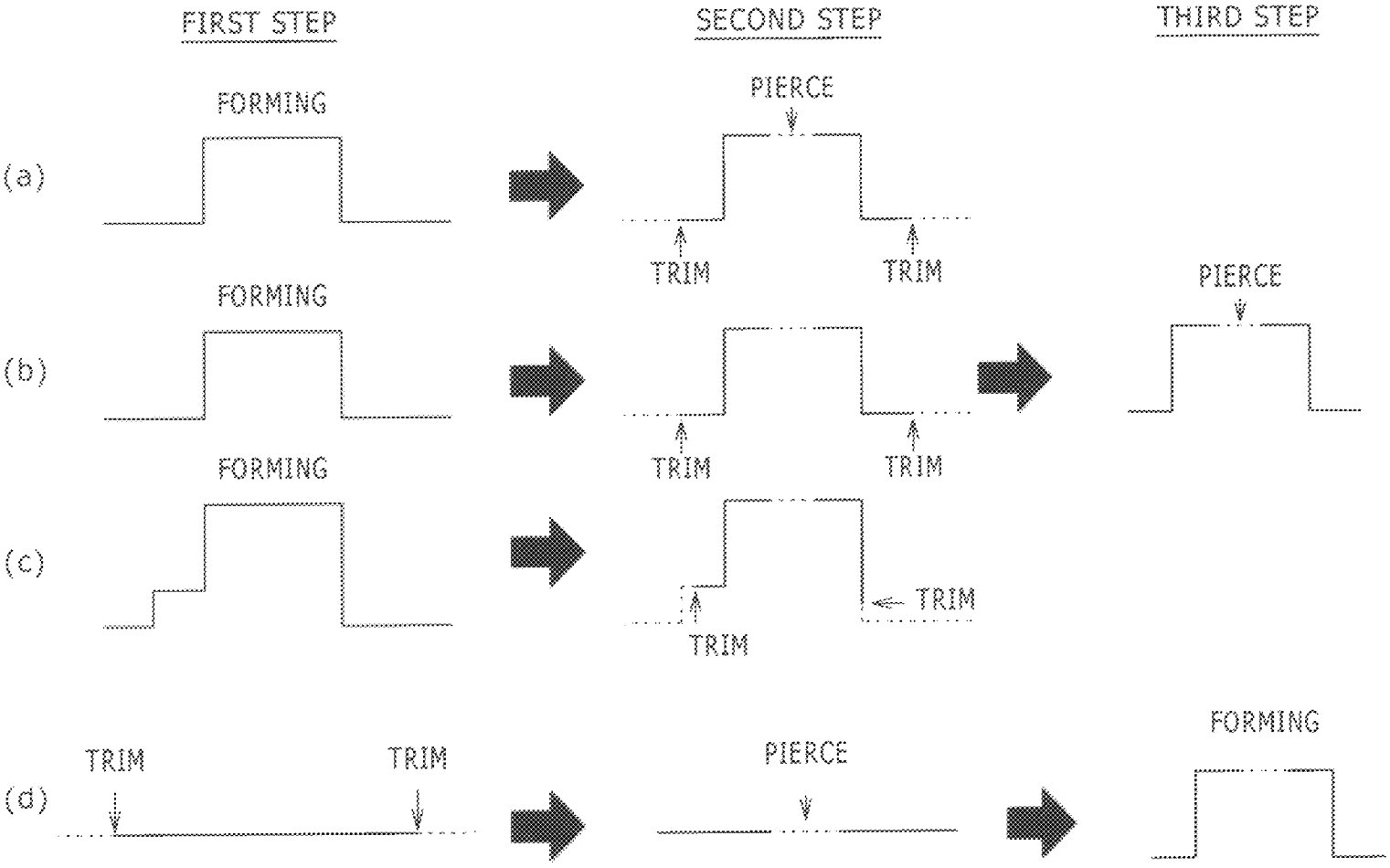
FIG. 7 includes schematic illustrations each illustrating an example of piercing or (peripheral) trimming in a multistage forming process.

In another example of the multistage forming, when a material is at a relatively high temperature and is thus soft in the second step or later, punching, etc. can be performed. For example, as illustrated in FIGS. 7(*a*) to 7(*c*), piercing (punching) and peripheral trimming (shearing) are performed in the second step or later. Consequently, while piercing and trimming have been performed by laser processing, etc. in different steps in traditional forming with holding at a bottom-dead-center (one-step forming), the piercing and trimming can be performed by press forming, leading to cost reduction. In addition, as illustrated in FIG. 7(*d*), peripheral trimming and piercing (punching) may be performed by hot working before forming.

As described above, while the start temperature of hot press forming must be the heating temperature or lower and the Ms point or higher, the finish temperature of hot press forming (finish temperature of final hot press forming, in the case of one-time hot press forming, simply referred to as "finish temperature of hot press forming") may be the Ms point or higher, or the Ms point or lower and (Ms point−150)° C. or higher without limitation.

In light of enabling easy working and a small forming load of press working, the finish temperature of final hot press forming should be the Ms point or higher. In light of improving dimension accuracy, the finish temperature should be the Ms point or lower and (Ms point−150)° C. or higher. Press forming is performed in such a temperature region (at timing where martensite transformation occurs), thereby dimension accuracy is remarkably improved. In particular, the hot press forming is performed plural times, and press forming for tool constraint (however, holding at a bottom dead center is not necessarily required) is performed as final hot press forming at the timing where martensite transformation occurs, thereby dimension accuracy is remarkably improved.

An embodiment of the hot press forming includes the following modes.

(I) Hot press forming: one time.

(I-1) Start temperature of hot press forming: heating temperature or lower and Ms point or higher, and finish temperature of hot press forming: Ms point or higher.

(I-2) Start temperature of hot press forming: heating temperature or lower and Ms point or higher, and finish temperature of hot press forming: Ms point or lower and (Ms point−150)° C. or higher.

(II) Hot press forming: several times.

(II-1) Start temperature of first hot press forming: heating temperature or lower and Ms point or higher, and finish temperature of final hot press forming: Ms point or higher.

(II-2) Start temperature of first hot press forming: heating temperature or lower and Ms point or higher, and finish temperature of final hot press forming: Ms point or lower and (Ms point−150)° C. or higher.

Any cooling rate is acceptable from the heating temperature to (Ms point−150)° C. For example, a material is cooled from the heating temperature to (Ms point−150)° C. at an average cooling rate of 2° C./sec or more (preferably, 5° C./sec or more). At such a level of cooling rate, martensite can be formed at the Ms point or lower as described below while ferrite, bainite, and the like are little formed, and consequently a member having a high strength of 1100 MPa or more can be readily produced.

For example, the cooling rate can be controlled by an appropriate combination of time from extraction of a material from a furnace to start of press forming (a cooling rate during conveyance, etc.), contact time to a press forming tool (contact time per forming×number of times) during hot press forming, in case of plural numbers of press forming, a cooling condition between forming operations (natural cooling, forced wind cooling, etc.), and a cooling condition after finish of press forming (after tool release) (natural cooling, forced wind cooling, etc.). In particular, in the case where a cooling rate at (Ms point−150)° C. or higher must be increased, contact time to the press forming tool is effectively lengthened. Such cooling conditions can be beforehand estimated by simulation, etc.

In the case where a chemical composition of a steel sheet has a Mn content of less than 2.0%, the cooling rate from the heating temperature to the Ms point is preferably 10° C./sec in order to secure higher strength.

[Average Cooling Rate from (Ms Point−150)° C. to 40° C.: 5° C./sec or Less]

Traditional hot stamping mainly aims at achieving high strength. In such hot stamping, a cooling rate after hot press forming is therefore recommended to be increased to the utmost, but it is not so considered to be important to secure ductility.

In contrast, in the present invention, the average cooling rate from (Ms point−150)° C. to 40° C. is importantly specified to be 5° C./sec or less. In the present invention, on condition that a high-Si steel sheet is used, while martensite is precipitated to secure strength of a member, a cooling rate after forming is intentionally decreased, thereby a certain amount or more of retained γ can be secured in a microstructure of a resultant steel member, and consequently desired characteristics (excellent ductility, excellent delayed fracture resistance, and excellent crashworthiness) can be achieved.

In the present invention, the steel member is not held for a long time at a bottom dead center unlike the traditional hot stamping in order to achieve the above-described average cooling rate. In this way, the steel member is not held for a long time at the bottom dead center. As a result, the time required for single hot press forming is also shortened, and thus the time required for manufacturing one component is also shortened, leading to an increase in productivity.

The average cooling rate is preferably 3° C./sec or less, and more preferably 2° C./sec or less. The lower limit of the average cooling rate is about 0.1° C./sec in light of productivity, etc.

The average cooling rate can be achieved by releasing the steel member from a tool after hot press forming, and leaving the steel member for natural cooling, forced wind cooling, or the like. Alternatively, the steel member may be held in a warmer for a certain time followed by natural cooling, forced wind cooling, or the like, as necessary.

As described above, when a steel member is slowly cooled in a temperature range of the Ms point or lower, the member is tempered along with formation of martensite; hence strength of the member is easily reduced. In the present invention, a steel sheet containing a certain amount or more of Si is used to prevent such tempering.

The cooling finish temperature at the above-described average cooling rate may be 40° C. Alternatively, the steel member may be slowly cooled to a further low temperature range or room temperature at the average cooling rate of 5° C./sec or less.

In an Example in PTL3, steel sheets having various compositions are prepared and are "cooled to the Ms point or lower at a predetermined cooling rate". However, for example, as in a steel type E in Table 6 in PTL3, when a steel sheet having a low Si content is used, high strength as shown in Table 7 is possibly not shown except by rapidly cooling the steel sheet to a low temperature region considerably lower than the Ms point. That is, in Example 6 in PTL3, a steel sheet having any of the compositions is "cooled to the Ms point or lower at a predetermined cooling rate", and thus a high-strength member is produced. However, the steel sheet is rapidly cooled to a low temperature region considerably lower than the Ms point, and therefore the average cooling rate from (Ms point−150)° C. to 40° C. is possibly not 5° C./sec or less unlike the present invention. Furthermore, in PTL3, the steel sheet is rapidly cooled to the low temperature region as described above. As a result, retained γ is possibly not sufficiently secured.

Figure 8:
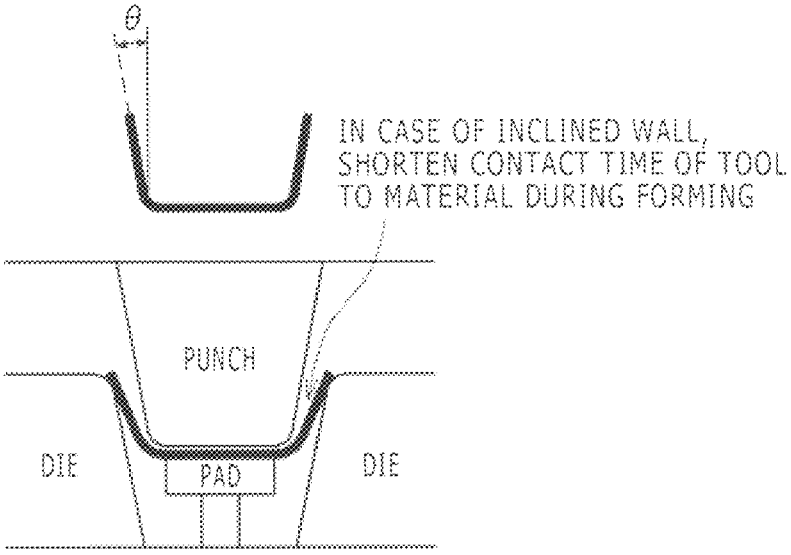
FIG. 8 is a schematic illustration of forming of a steel member in the case where a vertical wall of a target shape has a large inclination angle θ.

In the case of large thickness, or in the case where a vertical wall of a target shape of the steel member has a large inclination angle θ as illustrated in FIG. 8, the final-forming finish temperature may be difficult to be lowered to the Ms point or lower without holding at a bottom dead center even if the number of times of press forming is increased. In such a case, a tool structure as illustrated in FIG. 9 is used, thereby contact time of a blank (material) to the tool is increased without holding at a bottom dead center, thus allowing the final-forming finish temperature to be controlled to the Ms point or lower.

Figure 9:
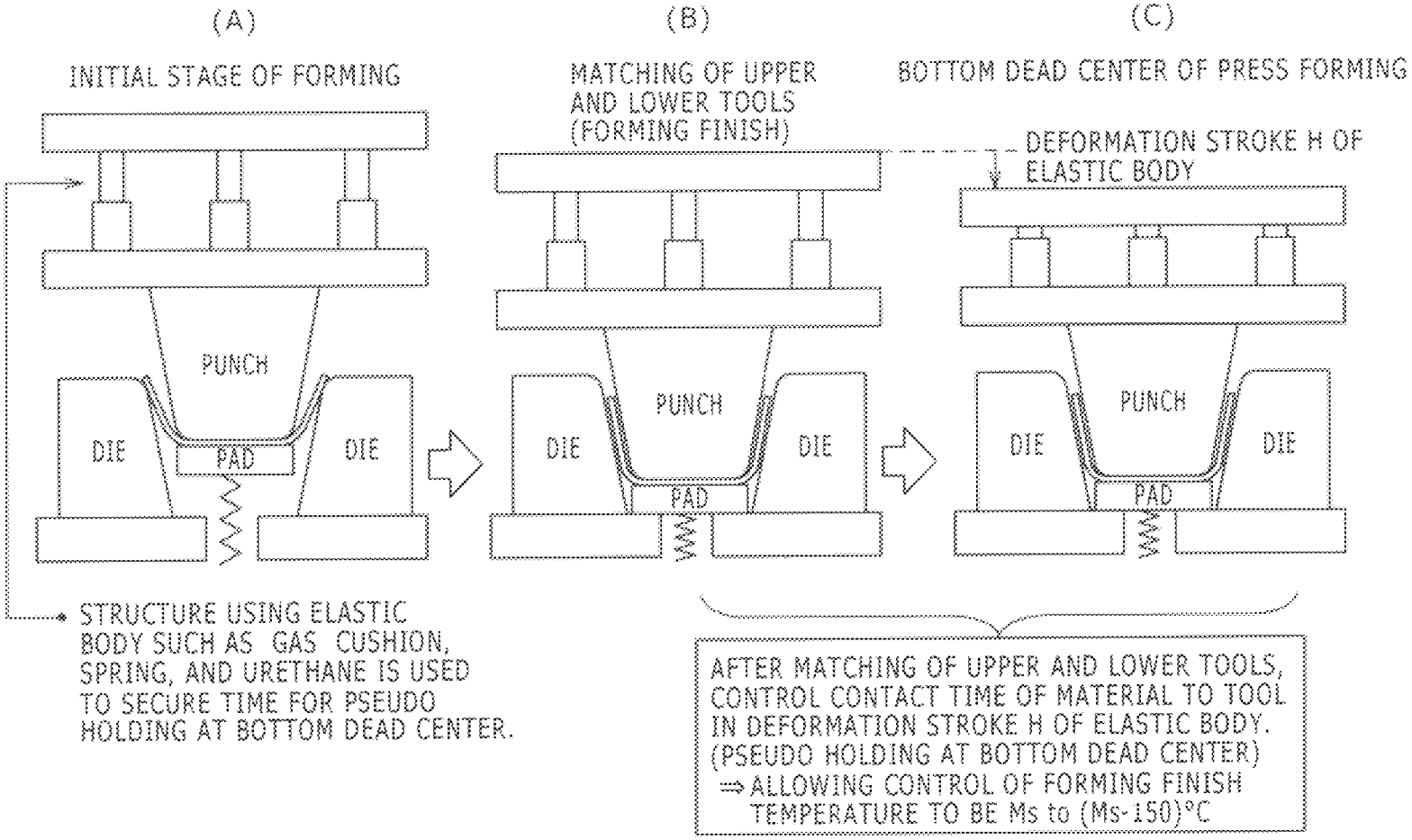
FIG. 9 includes schematic illustrations of a tool structure usable in the present invention.
Figure 10:
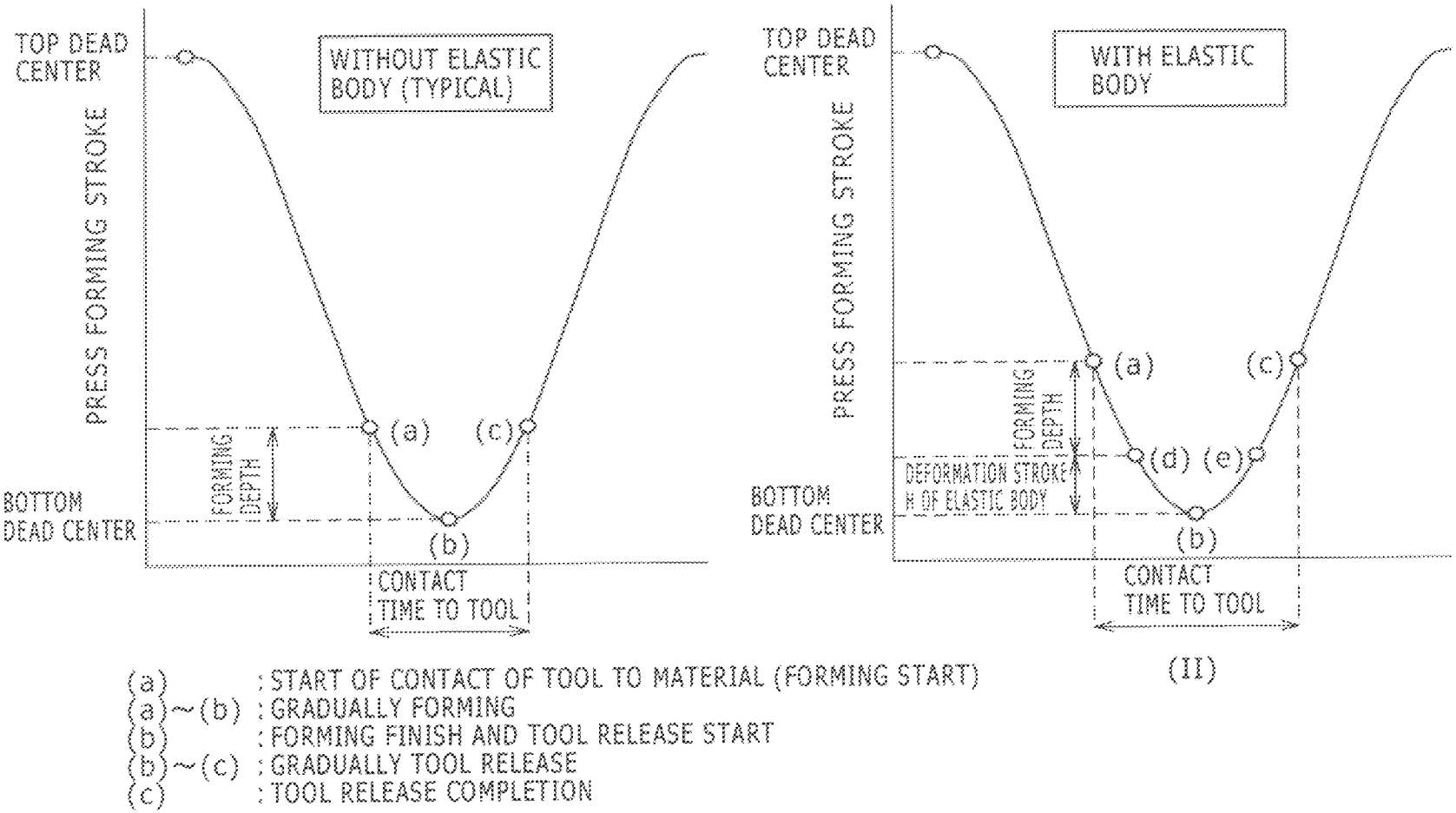
FIG. 10 includes diagrams each explaining one cycle of forming with a tool.

The tool structure in FIG. 9 is now described together with FIG. 10(II). FIG. 10(I) illustrates one cycle of forming with a traditional tool (including no elastic body), and FIG. 10(II) illustrates one cycle of forming with the tool (including an elastic body)) of FIG. 9.

In the tool structure in FIG. 9, upper and lower tools of the tool match with each other, and then contact time of a blank (material) to the tool is controlled (pseudo holding at a bottom dead center is performed) using a deformation stroke of an elastic body such as a gas cushion, a spring, and urethane disposed in an upper part of the tool. Consequently, forming finish temperature can be controlled to the Ms point or lower.

In detail, as illustrated in FIG. 10(II), contact of the tool to the blank (material) starts at the point (a), and forming is performed in a period from the point (a) to the point (d) (in this period, although the pad in FIG. 9 contracts, the elastic body is not deformed (does not expand and contract) (a state of FIG. 9(A)). At the point (d), the pad in FIG. 9 completely contracts, and deformation (contraction) of the elastic body starts (a state of FIG. 9(B)). In a period from the point (d) to the point (b), deformation (contraction) of the elastic body proceeds. At the point (b), the elastic body completely contracts (a state of FIG. 9(C)). Subsequently, in a period from the point (b) to the point (e), only the elastic body expands while the contact state between the tool and the blank (material) is maintained. At the point (e), the elastic body returns into an original state (i.e., into a completely expanding state), and release of the tool starts. In a period from the point (e) to the point (c), the tool is released (during which the pad in FIG. 9 expands, but the elastic body is not deformed). The tool release is completed at the point (c).

While the elastic body is provided in the upper part of the tool, the elastic body may be provided in a lower part thereof. Although deformation of the elastic body desirably starts after the upper and lower tools of the tool match with each other, even if the deformation of the elastic body starts before such matching, forming finish temperature can be controlled. Furthermore, this tool structure may be used only in a particular step in multistage forming.

[Steel Sheet (Blank) to Be Used for Hot Press Forming]

The steel sheet to be used for hot press forming is now described. First, a chemical composition of the blank used in the above-described manufacturing method is as follows.

(Chemical Composition of Blank)

[C: 0.10 to 0.30%]

Strength of a steel member is primarily determined by C content. In the present invention, the C content must be 0.10% or more in order to achieve high strength by the manufacturing method. The C content is preferably 0.15% or more, and more preferably 0.17% or more. In light of securing the above-described strength, the upper limit of the C content is not limited. However, in consideration of characteristics (such as weldability and toughness) other than strength of the resultant member, the upper limit of the C content is 0.30% or less. The upper limit is preferably 0.25% or less.

[Si: 1.0 to 2.5%]

[Si+Al: 1.0 to 3.0% in Total]

In the present invention, at least 1.0% of Si is contained to prevent tempering and secure retained γ during slow cooling in a manufacturing process. The Si content is preferably 1.1% or more, and more preferably 1.5% or more. Excessive Si content results in degradation in toughness, etc. or formation of an internal oxide layer due to Si during heating of the blank, causing degradation in weldability and conversion treatment performance of the member. Hence, the Si content is 2.5% or less. The Si content is preferably 2.0% or less, and more preferably 1.8% or less.

Al is an element that contributes to formation of retained γ as with Si. In light of this, in the present invention, Si and Al are contained 1.0% or more (preferably 1.50% or more) in total. However, if amounts of such elements are each excessive, the effect is saturated. Hence, Si+Al is 3.0% or less, and preferably 2.5% or less in total.

[Mn: 1.5 to 3.0%]

Mn is an element useful for improving hardenability of a steel sheet and for reducing variations in hardness of the steel sheet after forming. Mn must be contained 1.5% or more to exhibit such effects. The Mn content is preferably 1.8% or more. However, an excessive Mn content of more than 3.0% results in saturation of the effects, and causes an increase in cost. The Mn content is preferably 2.8% or less.

The composition of the steel of the present invention is as described above, and the remainder thereof consists of iron and inevitable impurities (for example, P, S, N, O, As, Sb, and Sn). In the inevitable impurities, P and S are each preferably decreased to 0.02% or less in light of securing weldability, etc. If the N content is excessive, degradation in toughness after hot forming or degradation in weldability is caused; hence, the N content is preferably controlled to be 0.01% or less. Furthermore, O causes a surface defect; hence, the O content is preferably controlled to be 0.001% or less.

The following elements can be contained as additional elements within a range without disturbing the advantageous effects of the present invention.

[Cr: 1% or Less (not Including 0%)]

Cr is an element useful for improving hardenability of a steel sheet. Variations in hardness of a formed article can be promisingly reduced by containing the element. Cr is preferably contained 0.01% or more to exhibit such an effect. More preferably, Cr is contained 0.1% or more. However, excessive Cr content results in saturation of such an effect, and causes cost rise. Hence, the upper limit of Cr content is preferably 1%.

[Ti: 0.10% or Less (not Including 0%)]

Ti is an element that fixes N and secures the quenching effect by B. Furthermore, Ti also exhibits an effect of refining a microstructure, which advantageously facilitates formation of retained γ during cooling in a temperature range of (Ms point−150)° C. or lower. Ti is preferably contained 0.02% or more to exhibit such effects. More preferably, Ti is contained 0.03% or more. However, excessive Ti content results in an excessive increase in strength of the blank, and thus the blank is less likely to be cut into a predetermined shape before hot press forming. Hence, the Ti content is preferably 0.10% or less. More preferably, the Ti content is 0.07% or less.

[B: 0.005% or Less (not Including 0%)]

B is an element that improves hardenability of a steel sheet. B is preferably contained 0.0003% or more to exhibit such an effect. More preferably, B is contained 0.0015% or more, and further preferably 0.0020% or more. However, excessive B content results in precipitation of coarse iron nitride in a formed article, and thus toughness of the formed article is easily degraded. Consequently, the B content is preferably controlled to be 0.005% or less, more preferably 0.0040% or less, and further preferably 0.0035% or less.

[Ni and/or Cu: 0.5% or Less in Total (not Including 0%)]

Ni and Cu are each an element useful for improvement in corrosion resistance and further improvement in delayed fracture resistance of a formed article. Ni and Cu are preferably contained 0.01% or more in total to exhibit such effects. Ni and Cu are more preferably contained 0.1% or more in total. However, excessive total content of Ni and Cu causes occurrence of a surface defect during manufacturing of a steel sheet. Hence, the total content of Ni and Cu is preferably 0.5% or less. More preferably, the total content of Ni and Cu is 0.3% or less.

[Mo: 1% or Less (not Including 0%)]

Mo is an element useful for improving hardenability of a steel sheet. Variations in hardness of a formed article can be promisingly reduced by containing the element. Mo is preferably contained 0.01% or more to exhibit such an effect. More preferably, Mo is contained 0.1% or more. However, excessive Mo content results in saturation of such an effect, and causes cost rise. Hence, the upper limit of Mo content is preferably 1%.

[Nb: 0.05% or Less (not Including 0%)]

Nb exhibits an effect of refining a microstructure, which advantageously facilitates formation of retained γ during cooling in a temperature range of (Ms point−150)° C. or lower. Nb is preferably contained 0.005% or more to exhibit such an effect. More preferably, Nb is contained 0.01% or more. Excessive Nb content results in saturation of such an effect, and causes cost rise. Hence, the upper limit of Nb content is preferably 0.05%.

(Method of Manufacturing Blank)

The blank satisfying the above-described composition may be manufactured by any of typical methods without limitation, the method including in continuous casting, heating, hot rolling, pickling, and cold rolling, and including annealing as necessary. Further usable steel sheet includes a coated steel sheet (such as a galvanized steel sheet) corresponding to the resultant hot-rolled steel sheet or cold-rolled steel sheet being further subjected to coating (such as zinc-containing coating), and a hot-dip galvannealed steel sheet, etc. produced by alloying the coated layer.

[Hot-Press-Formed Steel Member]

The hot-press-formed steel member produced by the method of the present invention has the same chemical composition as that of the used blank, and has a steel microstructure containing retained austenite (retained γ) by 2 vol % or more of the entire microstructure. The steel member produced by the manufacturing method of the present invention contains 2 vol % or more of retained γ, and is therefore excellent in tensile elongation ductility, crashworthiness, and delayed fracture resistance. The amount of the retained γ is preferably 3 vol % or more, and more preferably 5 vol % or more.

In the steel microstructure of the steel member, the remainder other than the retained γ substantially consists of low-temperature transformation phases (such as martensite, tempered martensite, and bainitic ferrite). The term "substantially" means that a transformation microstructure such as ferrite and bainite formed at the Ms point or higher may be contained as a microstructure inevitably formed during a manufacturing process.

The resultant steel member is subjected to cutting such as trimming and piercing, so that, for example, an automotive steel component can be produced. In the present invention, as described above, the resultant steel member has excellent delayed fracture resistance; hence, even if the steel member is subjected to such working, delayed fracture may not occur in the worked portion.

The steel member may be used as the automotive steel component directly or after being subjected to the above-described working, the automotive steel component including, for example, an impact bar, a bumper, a reinforce, and a center pillar.

EXAMPLES

Although the present invention is now described in detail with Examples, the present invention should not be limited thereto, and modifications or alterations thereof may be obviously made within the scope without departing from the gist described before and later, all of which are included in the technical scope of the present invention.

Example 1

Figure 11:
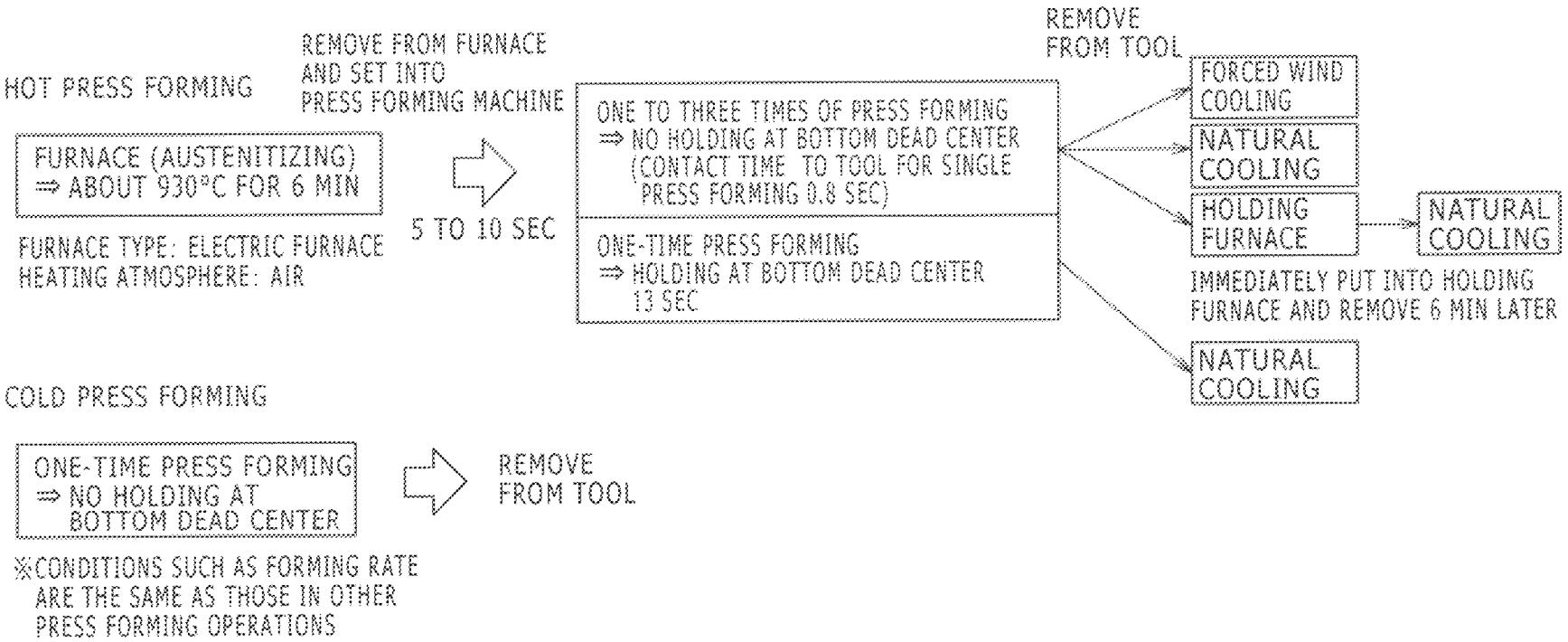
FIG. 11 is a diagram illustrating a hot press forming process and a cold press forming process performed in the Example.

A steel sheet (a blank with a size having a thickness of 1.4 mm, a width of 190.5 mm, and a length of 400 mm) having a chemical composition (the remainder consisting of iron and inevitable impurities) shown in Table 1 was prepared. The steel sheet was then subjected to press forming working, i.e., hot press forming or cold press forming, according to the procedure illustrated in FIG. 11. In Example 1, heating temperature in the hot press forming was 930° C., and start temperature of the hot press forming was 800 to 700° C. In Experiment Nos. 4 to 9 and 11 to 18 in Table 2 described later, Experiment No. 18 was subjected to forced wing cooling after press forming, and Experiment No. 7 was held in a holding furnace for 6 min after press forming, and was then subjected to natural cooling as illustrated in FIG. 11. Experiment Nos. 4 to 6, 8, 9, and 11 to 17 were each subjected to natural cooling without blower after press forming.

In each of formulas for calculation of the $Ac_3$ point and the Ms point shown in the margin of Table 1, any uncontained element was assumed to be zero for calculation.

Figure 12:
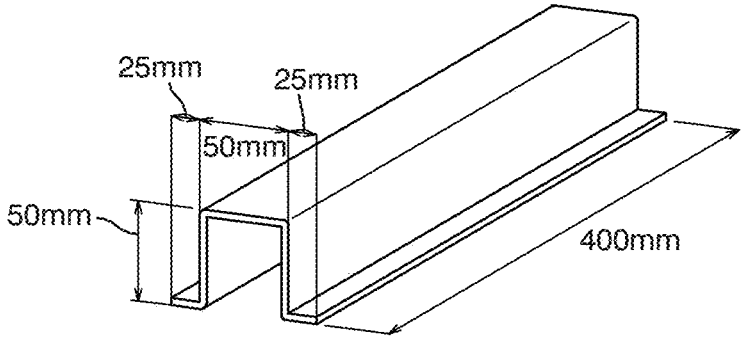
FIG. 12 is a schematic perspective diagram illustrating a shape of a steel member produced in the Example.

As illustrated in FIG. 1, in each of hot press forming and cold press forming, press forming (bending (form) forming using a leading pad) was performed using a press forming machine (400-ton mechanical press) to produce a steel member having a hat channel shape as illustrated in FIG. 12. A spring having a force of about 1 ton was used as a pressure source for the leading pad.

FIG. 1 illustrates a forming process, in which 1 represents a punch, 2 represents a die, 3 represents a leading pad, 4 represents a steel sheet (blank), and 5 represents a pin (spring-contained float pin).

As illustrated in FIG. 1(*a*), before start of press forming, each spring-contained pin 5 was disposed on the tool (the die 2 and the leading pad 3), and the blank 4 removed from a furnace was temporarily set on the pins 5 in order to avoid contact of the blank 4 to the tool (the die 2 and the leading pad 3) to the utmost.

FIG. 1(*b*) illustrates a state during the forming, in which the punch 1 is being lowered. FIG. 1(*c*) illustrates a state where the punch 1 is lowered to the bottom dead center (lower limit position). In the cold press forming, forming was performed using the steel sheet 4 at normal temperature without holding at the bottom dead center.

In Experiment No. 8 in Table 2 described later, the steel member was fabricated in the same way as Experiment No. 5 in Table 2 (the number of times of press forming: one) except that the number of times of press forming was three, and press forming was finished at the Ms point or lower and (Ms point−150)° C. or higher. In Experiment No. 9 in Table 2, the steel member was fabricated in the same way as Experiment No. 5 in Table 2 (the number of times of press forming: one) except that the number of times of press forming was two.

Figure 13:
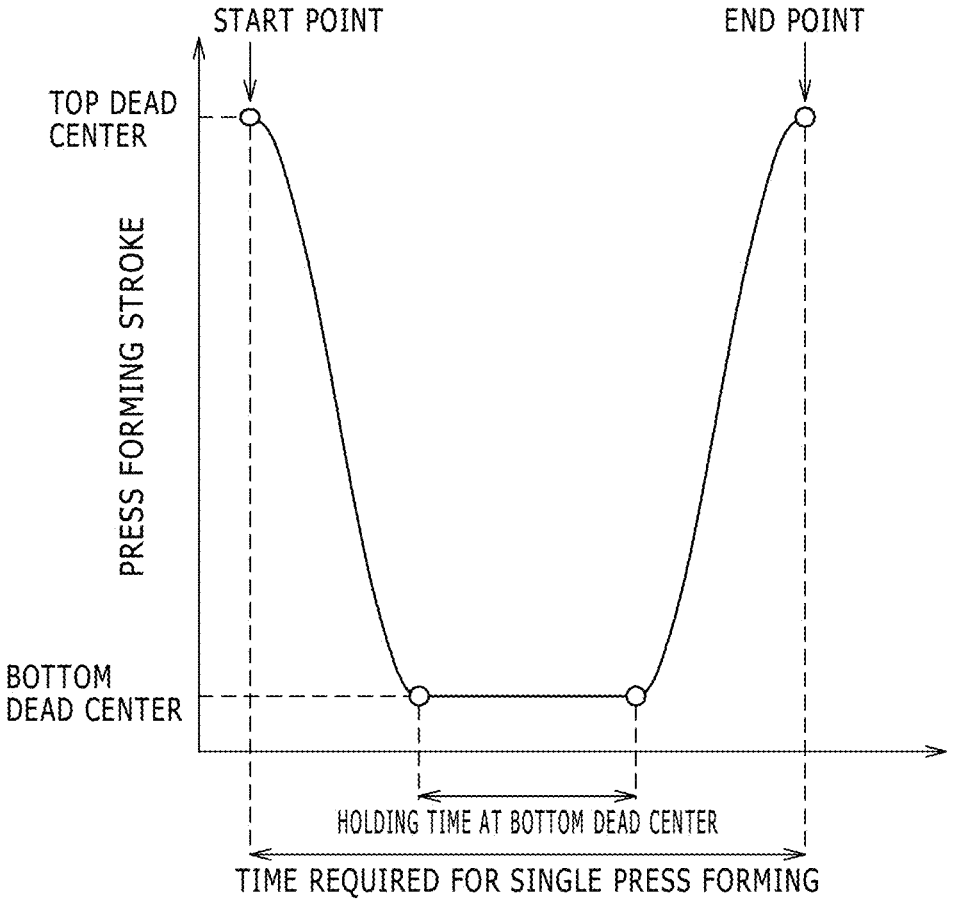
FIG. 13 is a diagram explaining the time required for one step of press forming (hot press forming or cold press forming) in the Example.

FIG. 13 illustrates one cycle of the forming, and "time required for single press forming" and "holding at bottom dead center" shown in Table 2 correspond to time required for single press forming and holding time at bottom dead center, respectively, illustrated in FIG. 13.

Figure 14:
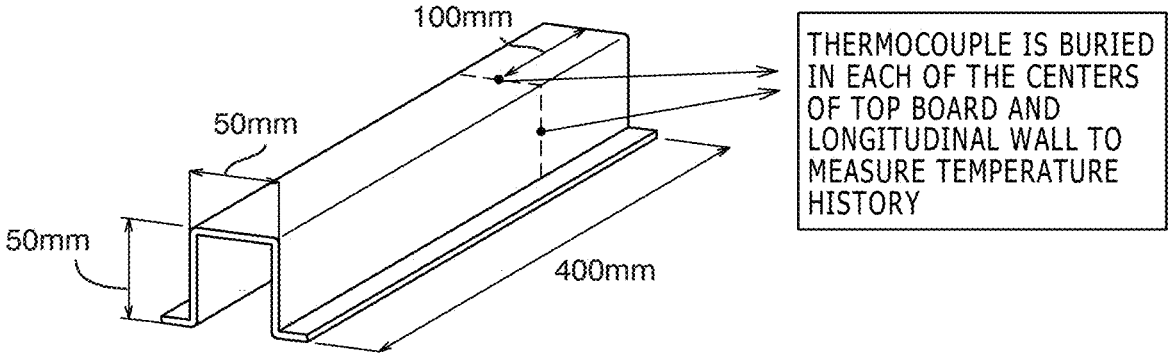
FIG. 14 is a diagram explaining buried positions of thermocouples for measurement of temperature of a steel sheet in the Example.

As illustrated in FIG. 14, the temperature history of the steel sheet in the fabrication of the steel member was measured with thermocouples that were buried in the center of a top board and the center of a longitudinal wall of the resultant steel member. Temperatures measured at such two points were substantially equal to each other.

A cooling rate from the heating temperature to the calculated (Ms point−150)° C. and a cooling rate from the (Ms point−150)° C. to 40° C. were each read from the measured temperature history, and the average cooling rate shown in Table 2 was calculated. The final tool release temperature shown in Table was determined from temperature indicated by each thermocouple and a corresponding tool position. In this Example, this final tool release temperature corresponds to the finish temperature of the final hot press forming.

The steel members (formed members) produced in the above way were used for investigation of steel microstructures, and were subjected to tensile tests and evaluation of ductility (bendability) as described below.

[Steel Microstructure]

The amount of retained austenite (retained γ) in a steel microstructure was measured according to the following procedure.

[Measurement Procedure of Amount of Retained γ]

A specimen 15 mm long and 15 mm wide was sampled from a top board of the steel member. The specimen was ground to one quarter of the thickness thereof and was then chemically polished, and was then subjected to measurement by X-ray diffraction (the measurement condition is as follows). Table 2 shows results of the measurement.

(Measurement Condition of X-Ray Diffraction)

X-ray irradiation area: about 20 μm×20 μm.

Target: Mo Kα.

Accelerating voltage: 20 kV.

Current: 250 mA.

Measuring crystal plane:

BCC (ferrite and martensite) . . . (200) plane and (211) plane.

FCC (austenite) . . . (200) plane, (220) plane, and (311) plane.

In any of Examples, it was confirmed that the remainder consisted of low-temperature transformation phases (such as martensite, tempered martensite, bainite, and bainitic ferrite).

[Tensile Test]

Figure 15:
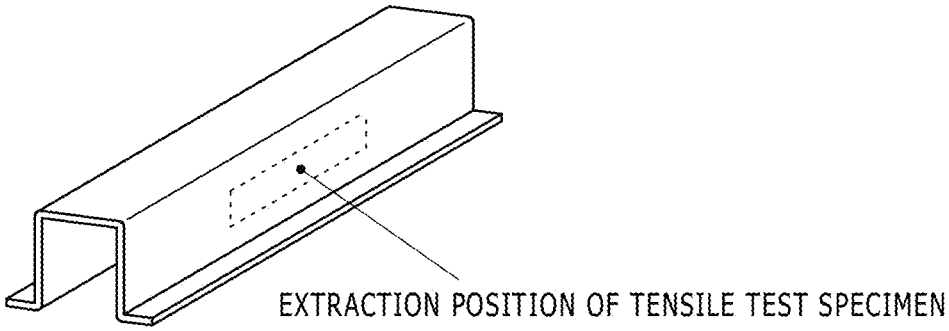
FIG. 15 is a diagram illustrating a sampling position of a tensile test specimen from a steel member in the Example.

As illustrated in FIG. 15, a JIS-5 specimen was cut out as a tensile test specimen from part of the formed component (steel member). Subsequently, yield strength (YS), tensile strength (TS), and elongation (El) were measured by a procedure specified in JIS Z 2241 with a strain rate of 10 mm/min using an AG-IS 250 kN autograph tensile tester from Shimadzu Corporation. Table 2 shows results of the measurement.

TABLE 1

| Blank symbol | Chemical composition of blank (mass %) (The remainder consisting of iron and inevitable impurities) | | | | | | | | | | | | | Si + Al (mass %) | $Ac_3$ [X1] (° C.) | Ms [X2] (° C.) | Type |
|---|---|---|---|---|---|---|---|---|---|---|---|---|---|---|---|---|---|
| | C | Si | Mn | P | S | Al | Cr | Ti | B | N | O | Cu | Ni | | | | |
| A | 0.22 | 0.19 | 1.22 | 0.005 | 0.001 | 0.041 | 0.31 | 0.026 | 0.0015 | 0.0044 | 0.0003 | — | — | 0.231 | 823 | 424 | Hot-rolled and pickled material |
| B | 0.18 | 1.91 | 2.51 | 0.005 | 0.001 | 0.042 | 0.11 | 0.025 | 0.0025 | 0.0055 | 0.0005 | 0.11 | 0.10 | 1.952 | 908 | 384 | As cold-rolled |
| C | 0.18 | 1.68 | 2.21 | 0.005 | 0.001 | 0.035 | 0.12 | 0.021 | 0.0011 | 0.0055 | 0.0005 | — | — | 1.715 | 899 | 399 | As cold-rolled |
| D | 0.18 | 1.91 | 2.51 | 0.005 | 0.001 | 0.042 | 0.11 | 0.025 | 0.0025 | 0.0055 | 0.0005 | 0.11 | 0.10 | 1.952 | 908 | 384 | Cold-rolled and annealed material |
| E | 0.22 | 1.05 | 2.42 | 0.004 | 0.002 | 0.037 | — | 0.02 | 0.0013 | 0.0043 | 0.0005 | — | — | 1.087 | 862 | 377 | As cold-rolled |
| F | 0.22 | 1.16 | 2.21 | 0.004 | 0.002 | 0.036 | — | 0.02 | 0.0013 | 0.0046 | 0.0005 | — | — | 1.196 | 867 | 386 | As cold-rolled |
| G | 0.21 | 1.00 | 2.03 | 0.004 | 0.002 | 0.036 | — | 0.02 | 0.0012 | 0.0043 | 0.0005 | — | — | 1.036 | 862 | 396 | As cold-rolled |
| H | 0.21 | 1.34 | 2.44 | 0.004 | 0.002 | 0.036 | — | 0.021 | 0.0013 | 0.0042 | 0.0005 | — | — | 1.376 | 877 | 380 | As cold-rolled |
| I | 0.21 | 1.29 | 2.24 | 0.004 | 0.002 | 0.037 | — | 0.021 | 0.0010 | 0.0045 | 0.0005 | — | — | 1.327 | 875 | 389 | As cold-rolled |
| J | 0.21 | 1.28 | 2.00 | 0.004 | 0.002 | 0.036 | — | 0.021 | 0.0010 | 0.0043 | 0.0005 | — | — | 1.316 | 874 | 397 | As cold-rolled |
| K | 0.19 | 1.35 | 1.82 | 0.004 | 0.003 | 0.039 | 0.12 | 0.021 | 0.0015 | 0.0043 | 0.0005 | — | — | 1.389 | 882 | 412 | As cold-rolled |
| L | 0.18 | 1.35 | 2.30 | 0.003 | 0.001 | 0.041 | — | — | — | 0.0045 | 0.0005 | — | — | 1.391 | 884 | 396 | As cold-rolled |

[X1] $Ac_3$ point: $910 - 203 \times \sqrt{[C]} - 15.2 \times [Ni] + 44.7 \times [Si] + 104 \times [V] + 31.5 \times [Mo] + 13.1 \times [W]$

[X2] Ms point: $550 - 350 \times [C] - 40 \times [Mn] - 35 \times [V] - 17 \times [Ni] - 10 \times [Cu] - 10 \times [Mo] - 5 \times [W] + 30 \times [Al] + 15 \times [Co]$

TABLE 2

| Experiment No. | Blank symbol | Si content (mass %) | Press forming step | Time required for single press forming (sec) | Number of times of press forming for one component (times) | Time required for manufacturing one component (sec) | Holding time at bottom dead center (sec) |
|---|---|---|---|---|---|---|---|
| 1 | A | 0.19 | Hot press forming ※ | 15 | 1 | 15 | 13 |
| 2 | B | 1.91 | | | 1 | 15 | |
| 3 | C | 1.68 | | | 1 | 15 | |
| 4 | A | 0.19 | | 3 | 1 | 3 | None |
| 5 | B | 1.91 | | | 1 | 3 | |
| 6 | C | 1.68 | | | 1 | 3 | |
| 7 | B | 1.91 | | | 1 | 3 | |
| 8 | B | 1.91 | | | 3 | 9 | |
| 9 | B | 1.91 | | | 2 | 6 | |
| 10 | D | 1.91 | Cold press forming | 3 | 1 | 3 | None |
| 11 | E | 1.05 | Hot press forming | 3 | 3 | 9 | None |
| 12 | F | 1.16 | | | | | |
| 13 | G | 1.00 | | | | | |
| 14 | H | 1.34 | | | | | |
| 15 | I | 1.29 | | | | | |
| 16 | J | 1.28 | | | | | |
| 17 | K | 1.35 | | | | | |
| 18 | L | 1.35 | | | | | |

| Experiment No. | Final tool release temperature (° C.) | Presence of holding in holding furnace after tool release | Average cooling rate from heating temperature to (Ms point-150)° C. (° C./s) | Average cooling rate from (Ms point-150)° C. to 40° C. (° C./s) | Characteristics of steel member (formed member) YS (MPa) | TS (MPa) | El (%) | Amount of retained γ (vol %) |
|---|---|---|---|---|---|---|---|---|
| 1 | 75 | — | 41.5 | 17.0 | 1149 | 1512 | 7.5 | 0.5 |
| 2 | 67 | — | 41.5 | 17.0 | 1347 | 1666 | 9.2 | 0.7 |
| 3 | 65 | — | 41.5 | 17.0 | 1171 | 1564 | 9.3 | 0.8 |
| 4 | 600 | None | 3.5 | 0.2 | 1028 | 1080 | 6.2 | 0.2 |
| 5 | 626 | None | 3.5 | 0.2 | 1146 | 1584 | 10.2 | 5.7 |
| 6 | 580 | None | 3.5 | 0.2 | 1031 | 1490 | 10 | 5.8 |
| 7 | 605 | 150° C. | 2.4 | 0.2 | 1022 | 1479 | 11 | 7.0 |
| 8 | 350 | None | 4.2 | 0.3 | 1034 | 1506 | 10.5 | 6.8 |
| 9 | 405 | None | 4.1 | 0.3 | 1007 | 1479 | 10.7 | 6.0 |
| 10 | — | — | — | — | 1103 | 1518 | 7.5 | 1.4 |
| 11 | 350 | None | 4.2 | 0.3 | 916 | 1518 | 8.8 | 4.2 |
| 12 | | | | | 854 | 1480 | 8.4 | 4.0 |
| 13 | | | | | 875 | 1444 | 8.6 | 4.5 |
| 14 | | | | | 855 | 1537 | 11.5 | 5.0 |
| 15 | | | | | 825 | 1462 | 8.4 | 4.8 |
| 16 | | | | | 842 | 1443 | 13.7 | 4.8 |
| 17 | | | | | 893 | 1336 | 8.0 | 2.3 |
| 18 | | | | 2.0 | 772 | 1327 | 10.8 | 2.5 |

※ In each of Experiment Nos. 1 to 9 and 11 to 18, heating temperature was 930° C., and start temperature of hot press forming was 800 to 700° C.

The following consideration can be made from Tables 1 and 2. Specifically, in the case where the steel member was held at the bottom dead center, and was rapidly cooled to a low temperature region as each of Experiment Nos. 1 to 3, retained γ was not able to be sufficiently secured. In Experiment No. 4, although the manufacturing condition satisfied the subjects of the method specified by the present invention, the Si content of the blank was insufficient; hence, desired strength was not achieved, ductility was low, and retained γ could not be sufficiently secured.

On the other hand, in each of Experiment Nos. 5 to 9 and 11 to 18, the steel member was fabricated by a specified process using a blank having a specified composition, and thus the resultant steel member exhibited high tensile strength and high ductility, and had sufficient retained γ. In this way, the steel member having a certain amount or more of retained γ promisingly exhibits excellent delayed fracture resistance and crashworthiness. In addition, in each of Experiment Nos. 5 to 9 and 11 to 18, the steel member was not held at the bottom dead center during the forming; hence, the time required for manufacturing one component was extremely short. Specifically, in each of Experiment Nos. 5 to 9, the forming rate was 20 SPM (corresponding to production of 20 components per minute). Although the forming rate of 20 SPM was achieved in the case of cold press forming (Experiment No. 10), the resultant steel member had a ductility that was inferior to that of a steel member fabricated by the specified method.

Example 2

Subsequently, steel members produced in Experiment Nos. 1, 5, 8, and 10 to 18 in Table 2 were each subjected to a bending test for evaluation of bendability (workability).

(Bending Test)

Figure 16:
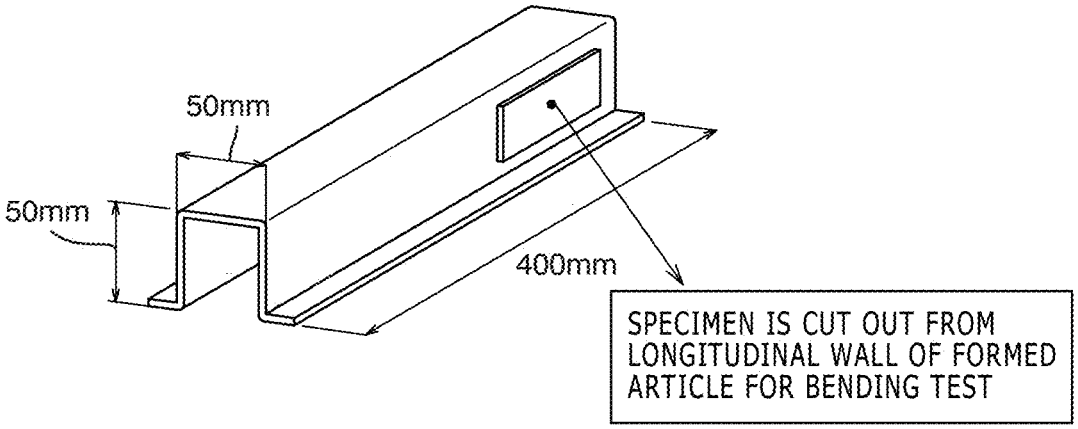
FIG. 16 is a diagram illustrating a sampling position of a bending test specimen from a steel member in another Example.
Figure 17:
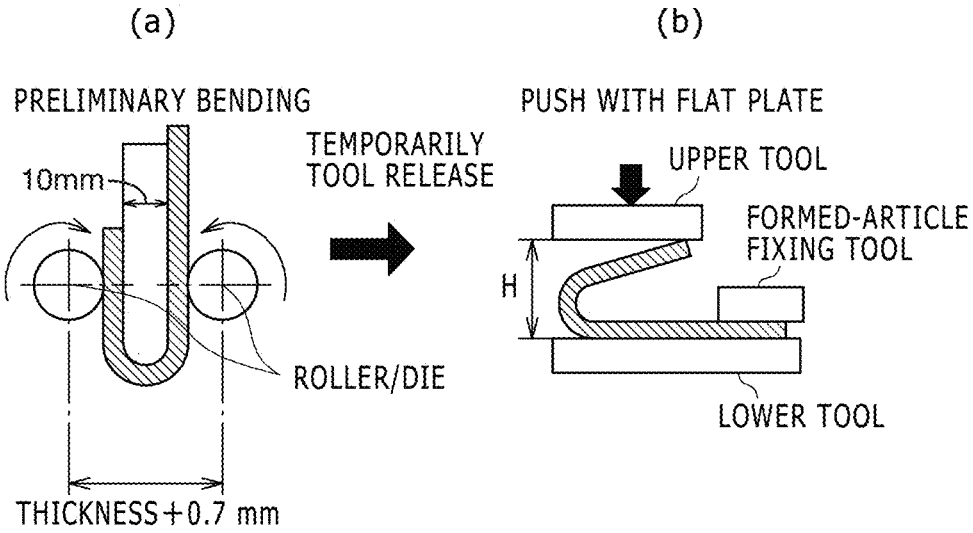
FIG. 17 includes illustrations of a bending test procedure in the Example.

As illustrated in FIG. 16, a steel strip 150 mm long and 30 mm wide was cut out as a bending test specimen from a longitudinal wall of the formed component (steel member). The specimen was subjected to preliminary bending as illustrated in FIG. 17(*a*). Subsequently, as illustrated in FIG.

Figure 18:
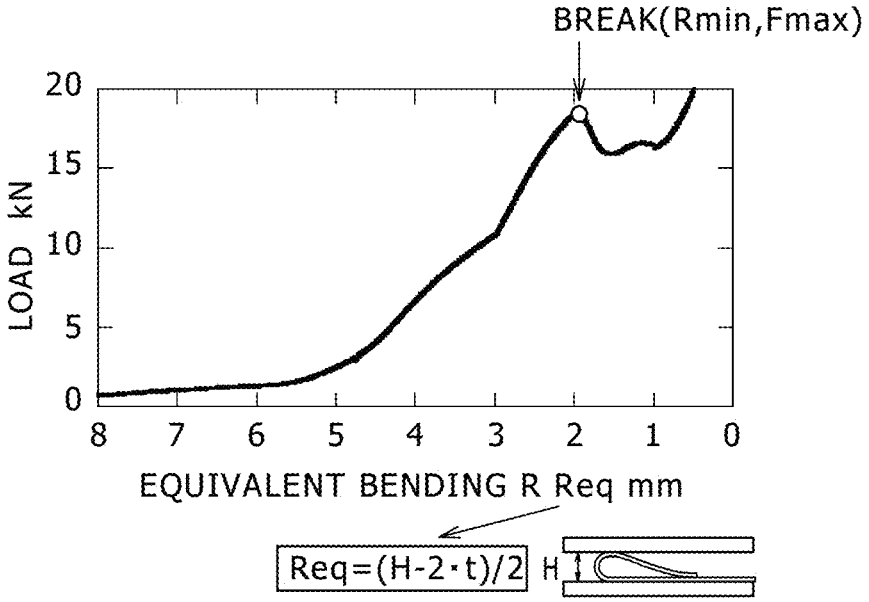
FIG. 18 is a diagram illustrating an example of a bending test result (a relationship between an equivalent bending radius (R) and a load) in the Example.

17(*b*), a first end of the specimen was fixed by pinching a fixing tool and a lower tool, and a second curved end thereof was pinched by an upper tool and the lower tool, and then a load was applied from the upper side of the upper tool until the specimen was broken. A load, at a point where a bent portion of the specimen was broken, was determined, and the equivalent bending radius (R) was determined by formula (1). Table 3 shows results of the bending test. FIG. 18 illustrates an exemplary relationship between the equivalent bending radius (R) and the load.

$$R=(H-2t)/2 \quad (1)$$

wherein

R is equivalent bending radius (R) (mm),

H is a distance (mm) between the upper and lower tools at break, and t is thickness (mm).

TABLE 3

| Experiment No. | Blank symbol | Si content (mass %) | Press forming | Amount of retained γ (vol %) | Equivalent bending radius (mm) | Maximum load in bending (kN) |
|---|---|---|---|---|---|---|
| 1 | A | 0.19 | Hot press forming | 0.5 | 4.0 | 2.6 |
| 5 | B | 1.91 | | 5.7 | 3.6 | 4.2 |
| 8 | B | 1.91 | | 6.8 | 3.9 | 3.4 |
| 10 | D | 1.91 | Cold press forming | 7.0 | 4.4 | 2.3 |
| 11 | E | 1.05 | Hot press forming | 4.2 | 3.8 | 4.2 |
| 12 | F | 1.16 | | 4.0 | 3.6 | 4.1 |
| 13 | G | 1.00 | | 4.5 | 3.0 | 5.9 |
| 14 | H | 1.34 | | 5.0 | 3.8 | 3.5 |
| 15 | I | 1.29 | | 4.8 | 3.9 | 3.1 |
| 16 | J | 1.28 | | 4.8 | 2.7 | 7.6 |
| 17 | K | 1.35 | | 2.3 | 2.5 | 7.9 |
| 18 | L | 1.35 | | 2.5 | 3.0 | 5.5 |

The following consideration can be made from Table 3. In Experiment No. 1, the Si content was insufficient, and the amount of retained γ was small; hence, the specimen was broken before being sufficiently bent. In other words, the specimen had a large equivalent bending radius at the break, and a small maximum load in bending. On the other hand, in each of Experiment Nos. 5, 8, and 11 to 18, the steel member had a small equivalent bending radius, and a large load at the break (the maximum load in bending). The steel member produced through cold press forming (Experiment No. 10) had bendability that was inferior to that of a steel member fabricated by the specified method.

Example 3

Subsequently, in the case where multistage press forming was performed, influence on dimension accuracy of each resultant steel member was investigated using steel members produced in Experiment Nos. 1, 5, and 8 to 10 in Table 2.

The dimension accuracy was evaluated through obtaining the maximum opening displacement as described below.

Figure 19:
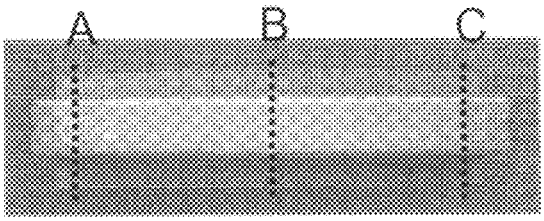
FIG. 19 is a diagram illustrating measurement points of opening displacement of a steel member in another Example.
Figure 20:
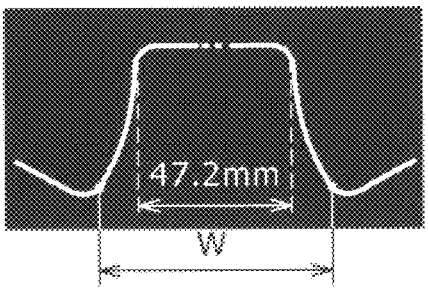
FIG. 20 is a diagram explaining how to determine the opening displacement in the Example.

FIG. 19 is a diagram illustrating measurement points of opening displacement of each resultant steel member. The opening displacement was determined at A, B, and C. With the opening displacement, as illustrated in FIG. 20, values of (W-47.2) in cross sections at A, B, and C were obtained, and a largest value among such values was determined as the maximum opening displacement. Table 4 shows results of the measurement.

TABLE 4

| Experiment No. | Blank symbol | Si content (mass %) | Press forming | Time required for single press forming (sec) | Number of times of press forming for one component (times) | Time required for manufacturing one component (sec) | Holding at bottom dead center (sec) | Maximum opening displacement (mm) |
|---|---|---|---|---|---|---|---|---|
| 1 | A | 0.19 | Hot press forming | 15 | 1 | 15 | 13 | 0.2 |
| 5 | B | 1.91 | Hot press forming | 3 | 1 | 3 | None | 4.5 |
| 8 | B | 1.91 | Hot press forming | 3 | 3 | 9 | None | 0.1 |
| 9 | B | 1.91 | Hot press forming | 3 | 2 | 6 | None | 2.4 |
| 10 | D | 1.91 | Cold press forming | 3 | 1 | 3 | None | 21.0 |

The following consideration can be made from Table 4. In Experiment No. 1, the specimen was held at the bottom dead center during the forming; hence, the maximum opening displacement was small, but much time was taken for manufacturing one steel member, leading to bad productivity. As in Experiment No. 10, in the case where cold press forming was performed, the maximum opening displacement was considerably large, and thus dimension accuracy was extremely bad.

On the other hand, in each of Experiment Nos. 5, 8, and 9 where hot press forming was performed by the specified method using the blank specified by the present invention, the maximum opening displacement was sufficiently controlled to be low. In the case of this degree of a variation in dimension accuracy, a shape of the steel member after hot press forming can be adjusted into predetermined dimensions through an approach where a certain dimension is beforehand allowed in a tool shape for a variation in dimension after tool release, or an approach where the member is devised in shape to have shape stiffness. In particular, as shown in Experiment No. 8, the number of times of press forming was large, and the final tool release temperature was the Ms point or lower, thereby dimension accuracy was able to be extremely improved while productivity was substantially not reduced.

Example 4

The material of the blank symbol B in Table 1 was formed into an arc shape. At this time, while the time required for single press forming, the number of times of press forming, and indentation depth were each varied, influence of such variations on dimension accuracy of the resultant steel member was investigated.

Figure 21:
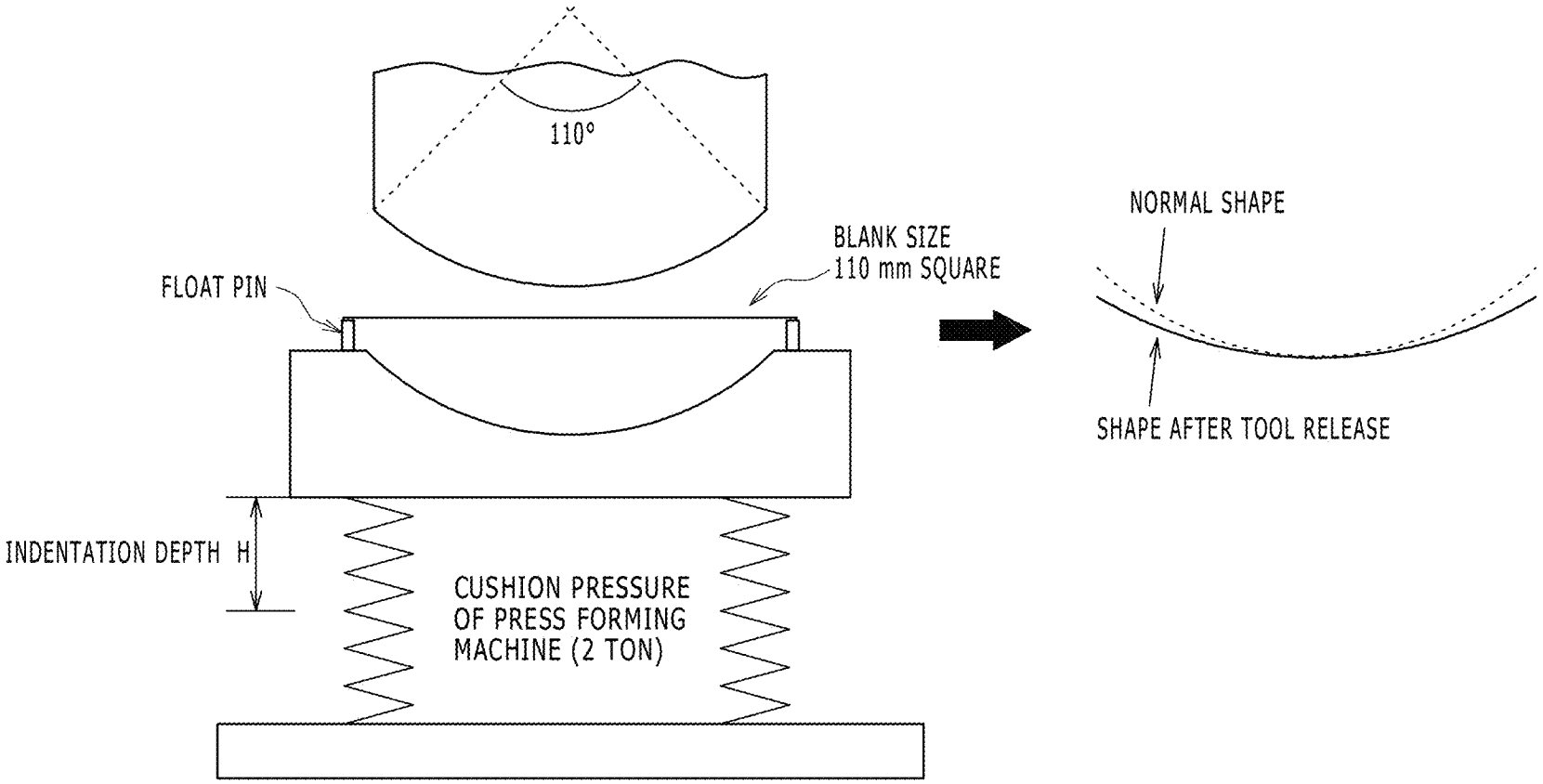
FIG. 21 is a schematic illustration of a forming unit (tool) used for evaluation of dimension accuracy in another Example.

The material (1.4 mm thick and 110 mm square) of the blank symbol B in Table 1 was heated to 930° C., and was then formed into an arc shape after being waited for 10 sec on float pins in a forming unit (tool) illustrated in FIG. 21. In the forming, time required for single press forming, the number of times of press forming, and indentation depth were varied as shown in Table 5 while the material was not held at the bottom dead center, thereby the final-forming finish temperature was varied. The forming was performed with the forming unit (tool) set in a crank press in the 780 kN class. In addition, R (the radius of curvature) of the arc shape after forming (tool release) was determined as R1. Forming, which allowed excellent dimension accuracy to be secured, was separately performed with holding at the bottom dead center (13 sec) and the final-forming finish temperature of 60° C. (forming under a reference condition) to produce an article formed under the reference condition, and R of the article was determined as R2. In addition, a value of R1−R2 was determined as "arc R variation", and was used as an evaluation index for dimension accuracy. Table 5 further shows results of such investigation.

TABLE 5

| Time required for single press forming (sec) | Holding at bottom dead center (sec) | Number of times of press forming (times) | Indentation depth H (mm) | Final-forming-step finish temperature (° C.) | Arc R variation (mm) |
|---|---|---|---|---|---|
| 2.1 | 0.0 | 1 | 50 | 465 | 1.1 |
| 3.0 | 0.0 | 1 | 5 | 596 | 8.1 |
| 3.0 | 0.0 | 1 | 14 | 532 | 2.8 |
| 3.0 | 0.0 | 1 | 46 | 400 | 0.5 |
| 3.0 | 0.0 | 1 | 50 | 465 | 1.0 |
| 3.0 | 0.0 | 1 | 70 | 337 | 0.2 |
| 3.5 | 0.0 | 1 | 48 | 362 | 0.1 |
| 3.5 | 0.0 | 1 | 70 | 244 | 0.0 |
| 2.1 | 0.0 | 2 | 50 | 351 | 0.0 |
| 3.0 | 0.0 | 2 | 14 | 403 | 0.4 |
| 3.0 | 0.0 | 3 | 14 | 348 | 0.2 |

Figure 22:
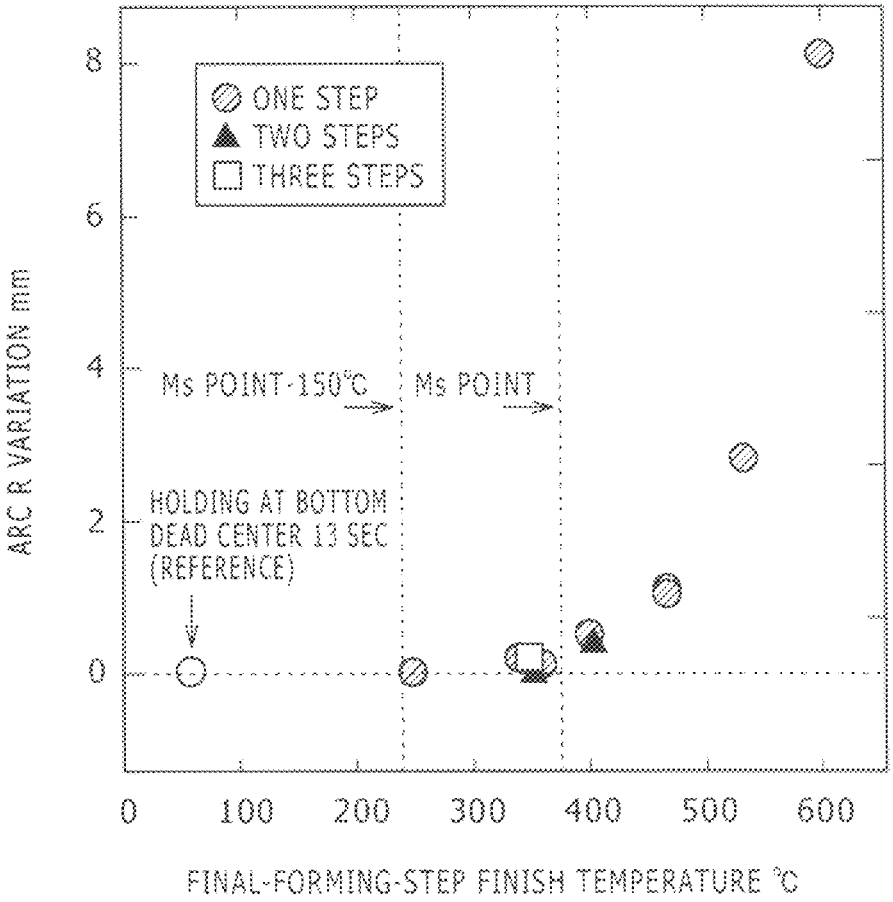
FIG. 22 is a diagram illustrating a relationship between final-forming finish temperature and an arc R variation in the Example.

FIG. 22 illustrates a relationship between the final-forming finish temperature and the arc R variation obtained through rearrangement of the results in Table 5. FIG. 22 reveals that if tool release is performed at the final-forming finish temperature of the Ms point or lower, dimension accuracy is extremely improved regardless of the number of times of press forming (one to three steps), thus achieving dimension accuracy similar to that obtained in a traditional technique with holding at a bottom dead center.

Example 5

The steel members of Experiment Nos. 1 and 8 in Table 2 were used for evaluation of a relationship between the crashworthiness and the above-described bendability.

(Specimen Preparation Procedure)

Figure 23:
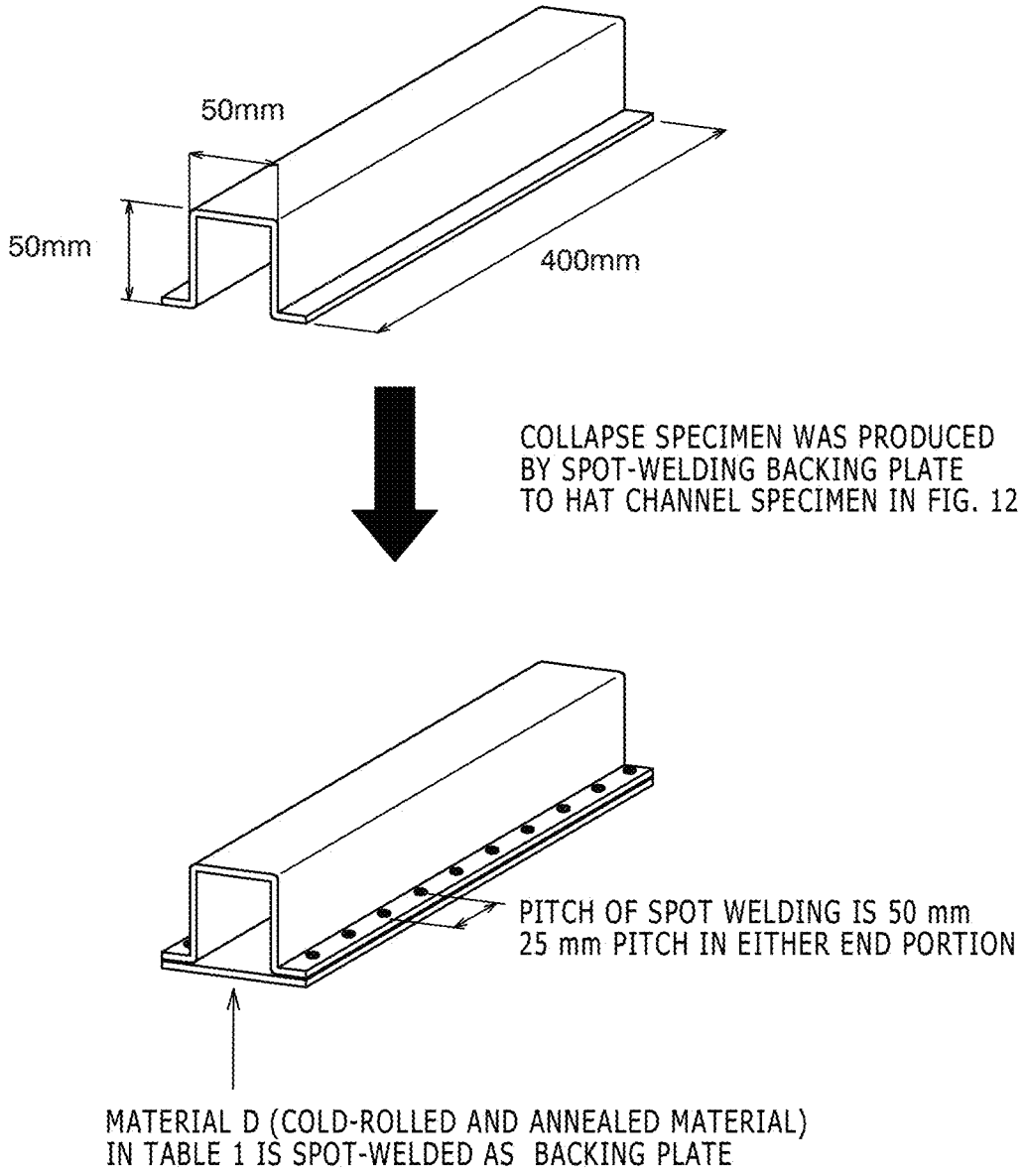
FIG. 23 is a schematic perspective diagram of a specimen used in a collapse test in another Example.

As illustrated in FIG. 23, a specimen was produced by spot welding of each of the steel members (each having a hat channel shape) of Experiment Nos. 1 and 8 in Table 2 to a backing plate assuming an actual component.

(Collapse Test Procedure)

Figure 24:
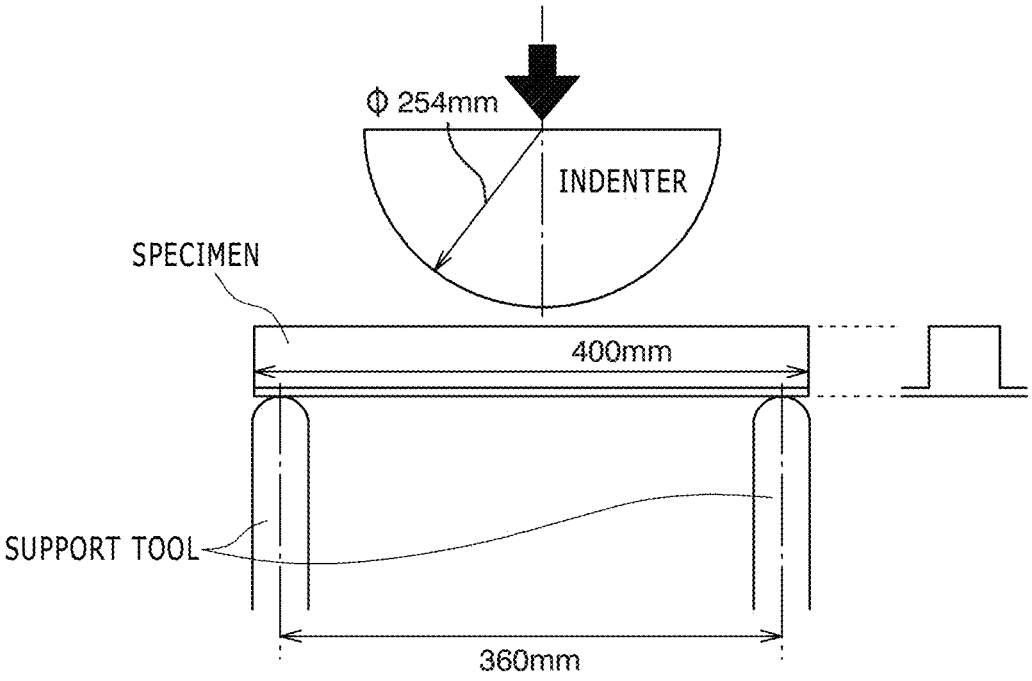
FIG. 24 is a schematic illustration of a procedure of a collapse test (three-point bend test) in the Example.
Figure 25:
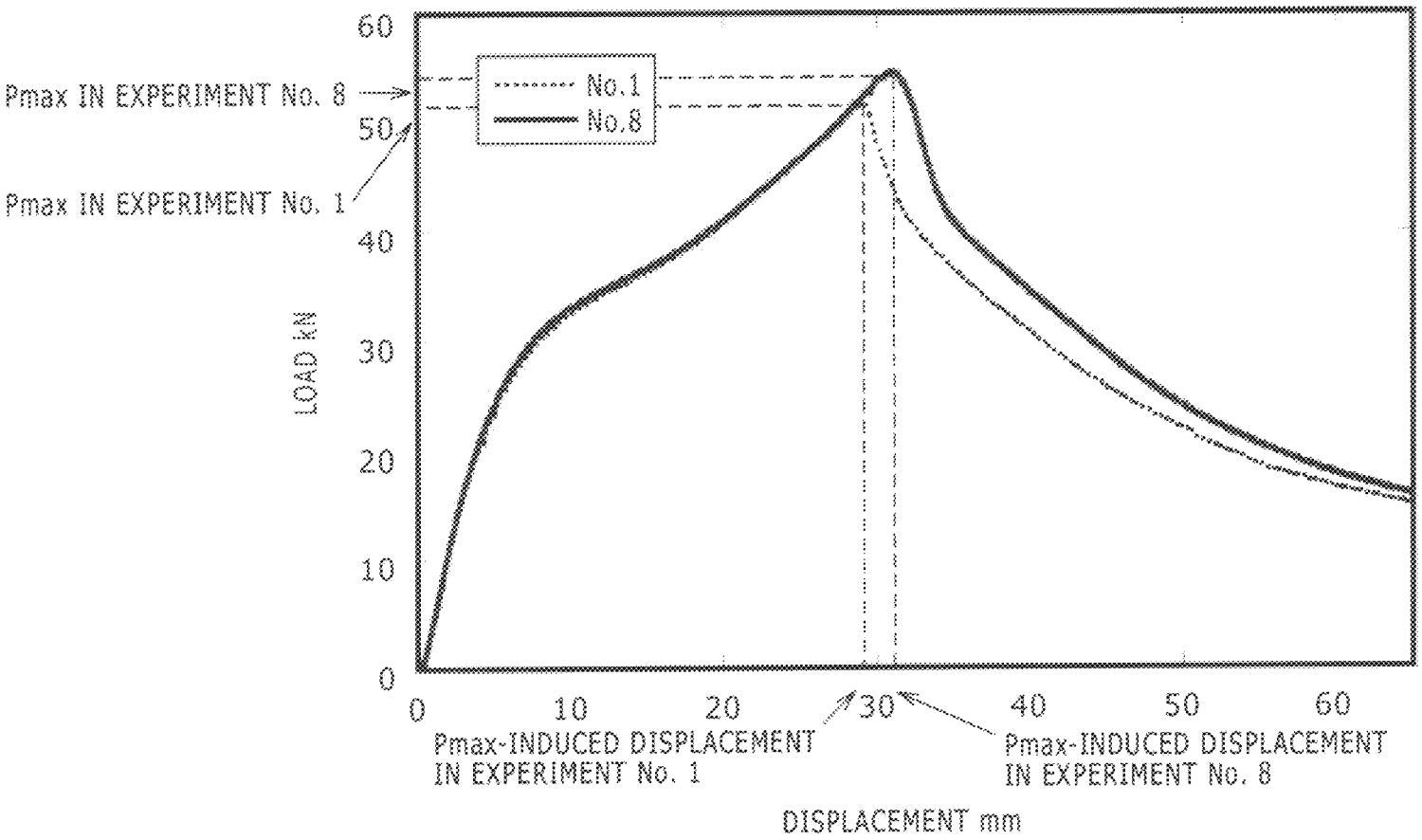
FIG. 25 is a diagram illustrating an example of a collapse test result (a load-displacement diagram) in the Example.
Figure 26:
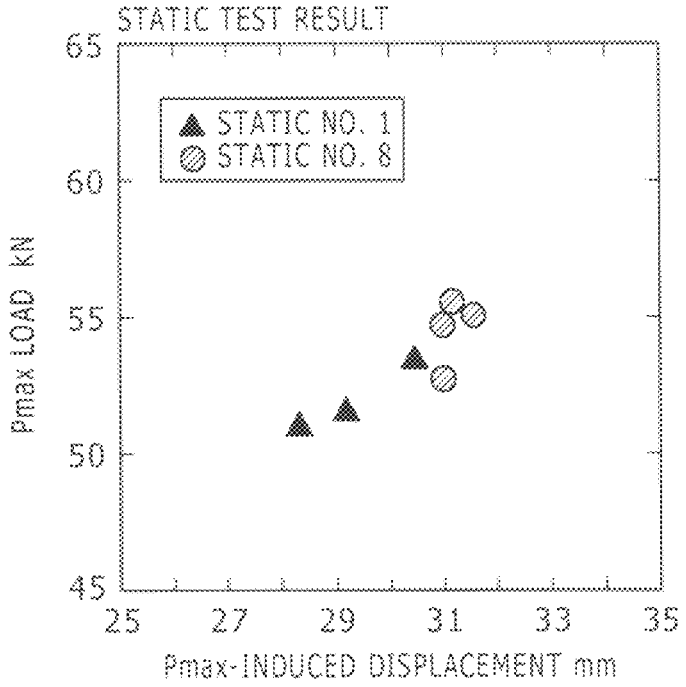
FIG. 26 is a diagram illustrating a collapse test (static test) result (a relationship between Pmax and Pmax-induced displacement) in the Example.
Figure 27:
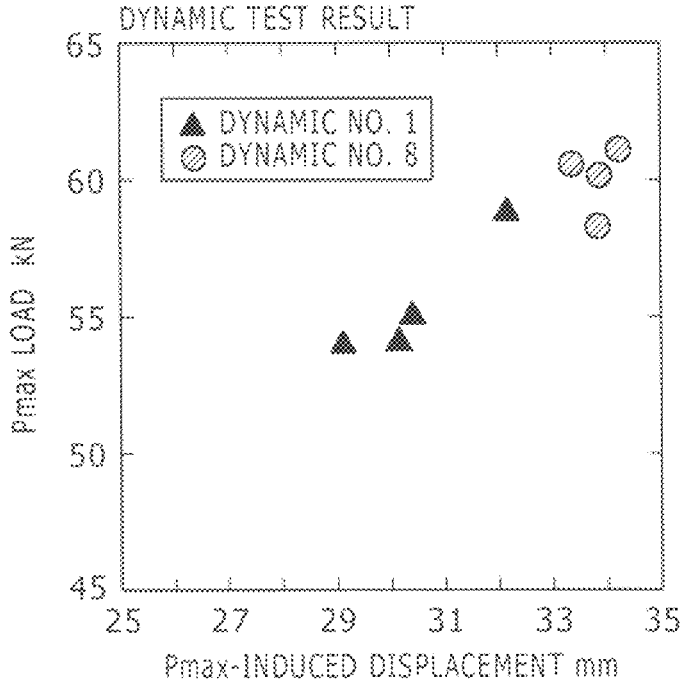
FIG. 27 is a diagram illustrating a collapse test (dynamic test) result (a relationship between Pmax and Pmax-induced displacement) in the Example.

As illustrated in FIG. 24, a three-point bend test (collapse test) was performed (an indenter had a semicircular column shape and a length in a paper depth direction of 150 mm). In this collapse test, two types of tests, i.e., a static test with a test speed of 1 mm/sec and a dynamic test with a test speed of 32 km/hr, were performed. Each of Experiment Nos. 1 and 8 was subjected to each of the static test and the dynamic test four times. A load-displacement diagram as illustrated in FIG. 25 was then obtained (FIG. 25 illustrates an example of static test results). In FIG. 25, the horizontal axis, i.e., "displacement" represents indentation depth assuming that the indentation depth is 0 when the indenter is contacted to the specimen. Similar measurement was performed for the dynamic test. In addition, the maximum load (Pmax) and displacement at the maximum load (Pmax-induced displacement) were determined for each of the tests. FIGS. 26 and 27 each show results of the tests.

FIG. 26 is a diagram illustrating a relationship between the maximum load (Pmax) and displacement at the maximum load (Pmax-induced displacement) in the static test. FIG. 27 is a diagram illustrating a relationship between the maximum load (Pmax) and displacement at the maximum load (Pmax-induced displacement) in the dynamic test. FIGS. 26 and 27 reveal that the steel member of the present invention (Experiment No. 8) is high in maximum load and is large in displacement at the maximum load compared with Experiment No. 1 (comparative example) in both of the static test and the dynamic test.

Figure 28:
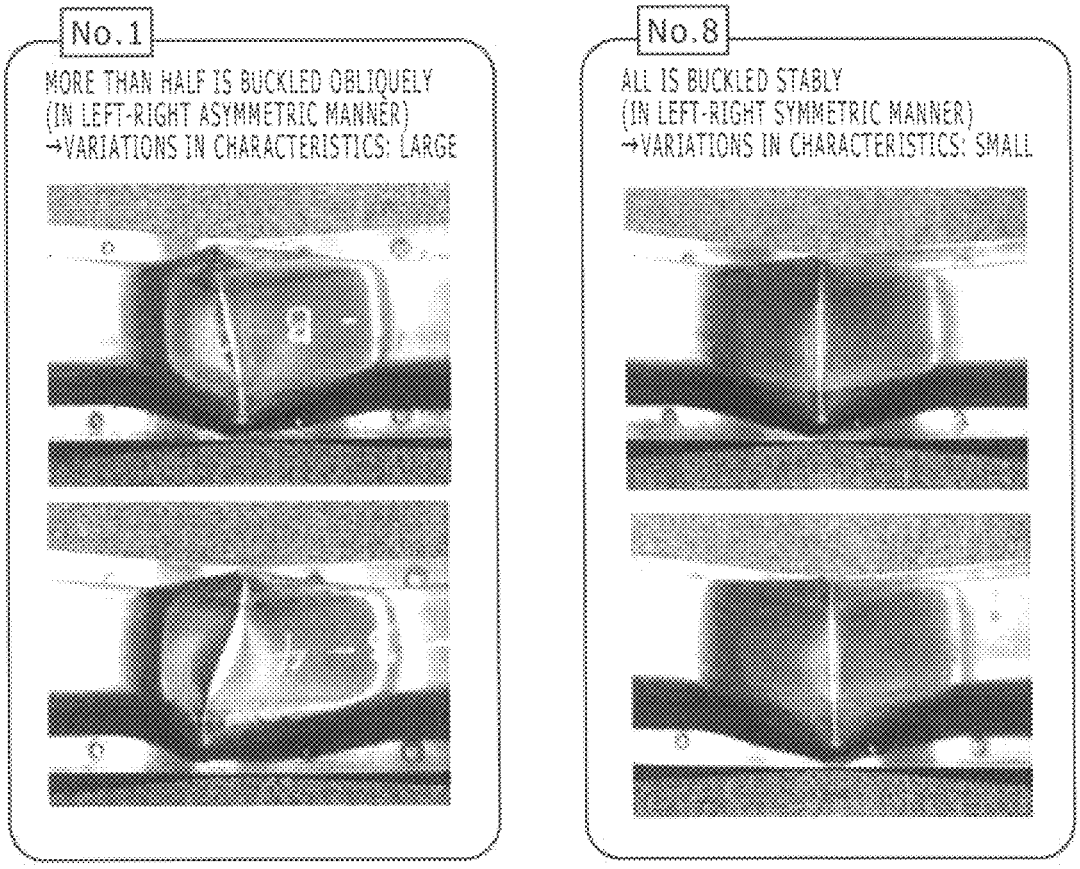
FIG. 28 includes photographs of tops of specimens after the collapse test in the Example.

FIG. 28 illustrates exemplary top photographs (after the static test) of the specimens after the collapse test in Experiment No. 1 and Experiment No. 8. As it is clear from the photographs, Experiment No. 8 shows a stable collapse position, namely, shows a stabilized buckling mode, i.e., stable crashworthiness.

Figure 30:
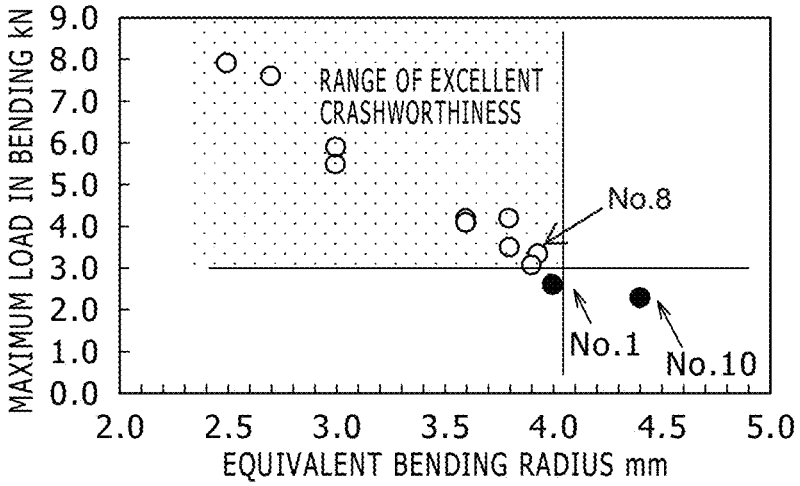
FIG. 30 is a diagram illustrating a relationship between an equivalent bending radius and a maximum load in bending in the Example.

As described above, high Pmax was achieved in the steel member of the present invention (Experiment No. 8). The reason (mechanism) for this is considered as follows. Specifically, the inventive article (Experiment No. 8) contains much retained γ, and is therefore exhibits large elongation. The inventive article is large not only in total elongation (El) shown in Table 2 but also in uniform elongation (the inventors have found that while the steel member of Experiment No. 1 shows a uniform elongation of 4.4%, the steel member of Experiment No. 8 shows a uniform elongation of 6.5%). This means that the strain dispersibility is higher (the work hardening coefficient n value is larger), and thus strain is more easily propagated in a wide range (a deformation region more easily spreads) in Experiment No. 8. As a result, local buckling (section collapse) is less likely to occur, and therefore a load is less likely to be decreased. Furthermore, bendability is excellent (Table 3 and FIG. 30); hence, material break is less likely to occur even after occurrence of buckling, and thus Pmax and Pmax-induced displacement are possibly increased. In this way, since Pmax-induced displacement and Pmax are increased together, absorbed energy is also increased. As a result, excellent crashworthiness are possibly exhibited.

Figure 29:
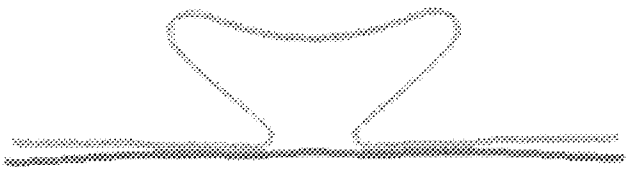
FIG. 29 includes cross section diagrams illustrating deformation images during collapse of the steel member illustrated in FIG. 23.
Figure 29:
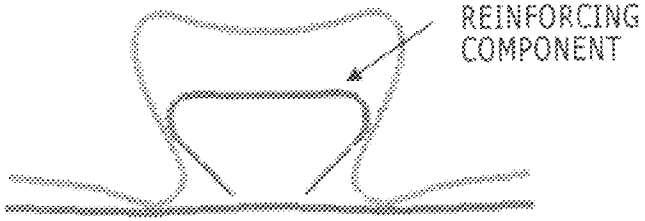

FIG. 29 includes cross sectional diagrams each illustrating a deformation image (a section at the center of the length of 400 mm in a longitudinal direction) during collapse of a steel member (with a backing plate). FIG. 29(*a*) illustrates a case with a reinforcing component, and FIG. 29(*b*) illustrates a case without a reinforcing component. As illustrated in FIG. 29(*b*), in the case where the reinforcing component is provided, a sectional shape is less likely to be collapsed (Sectional height is less likely to be decreased. Similar tendency is also shown in the case of large thickness and of a small sectional shape.) In the case where a member has the reinforcing component, deformation during collapse must be absorbed by ductility of a material of the member in correspondence to an uncollapsed level of the section. That is, ductility (uniform elongation, strain dispersibility, total elongation, and bendability) of a material greatly affects crashworthiness, i.e., crashworthiness are improved with an increase in ductility of the material. Consequently, the inventive article, which contains much retained γ and is large in elongation (Table 2) and excellent in bendability (FIG. 30), is promisingly excellent in crashworthiness as described in Example 5.

Example 6

Investigation was made on a relationship between the stretch-expand forming start temperature and stretch-expand forming performance in stretch-expand forming that was performed during hot press forming as an example of multistage forming.

Figure 31:
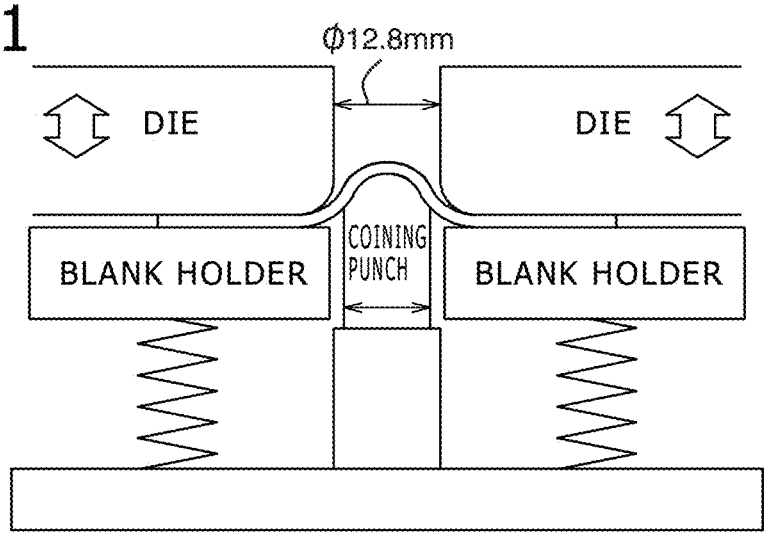
FIG. 31 is a schematic illustration of a test unit (tool) used for evaluation of stretch-expand formability in another Example.

The material (1.4 mm thick and 100 mm square) of the blank symbol B in Table 1 was heated to 930° C. Then, using a test unit (tool) of FIG. 31, the material was waited on the tool until temperature reached a predetermined forming start temperature (room temperature, 200° C., 300° C., 400° C., 500° C., 600° C., or 700° C.). At the predetermined forming start temperature, as illustrated in FIG. 31, stretch-expand forming (blank holder pressure: 2 tons) was performed with a coining punch 10 mm in diameter.

Figure 32:
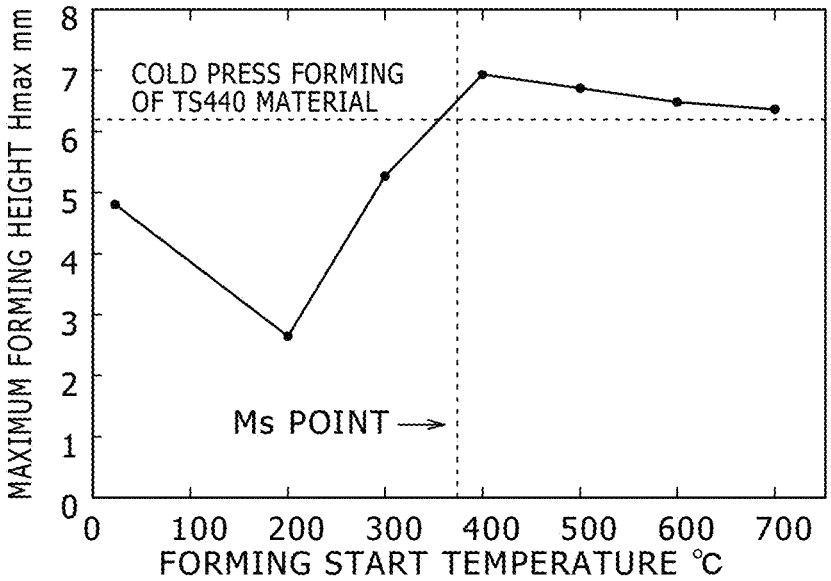
FIG. 32 is a diagram illustrating a relationship between (stretch-expand) forming start temperature and maximum forming height (of stretch-expand forming) in the Example.

In addition, (uncracked) maximum forming height (Hmax) in the stretch-expand forming was determined. FIG. 32 illustrates results of such determination in a form of a relationship between the forming start temperature and the maximum forming height. FIG. 32 reveals that the maximum forming height is 6 to 7 mm in a range of the forming start temperature of the Ms point or higher and less than about 400° C., showing excellent stretch-expand forming. This means that excellent stretch-expand formability, which is similar to that in cold press forming of steel in the tensile strength of 440 MPa class as illustrated in FIG. 32, can be secured.

Example 7

Investigation was made on a relationship between stretch flange forming start temperature (forming start temperature) and stretch flange formability in stretch flange forming that was performed during hot press forming as an example of multistage forming.

Figure 33:
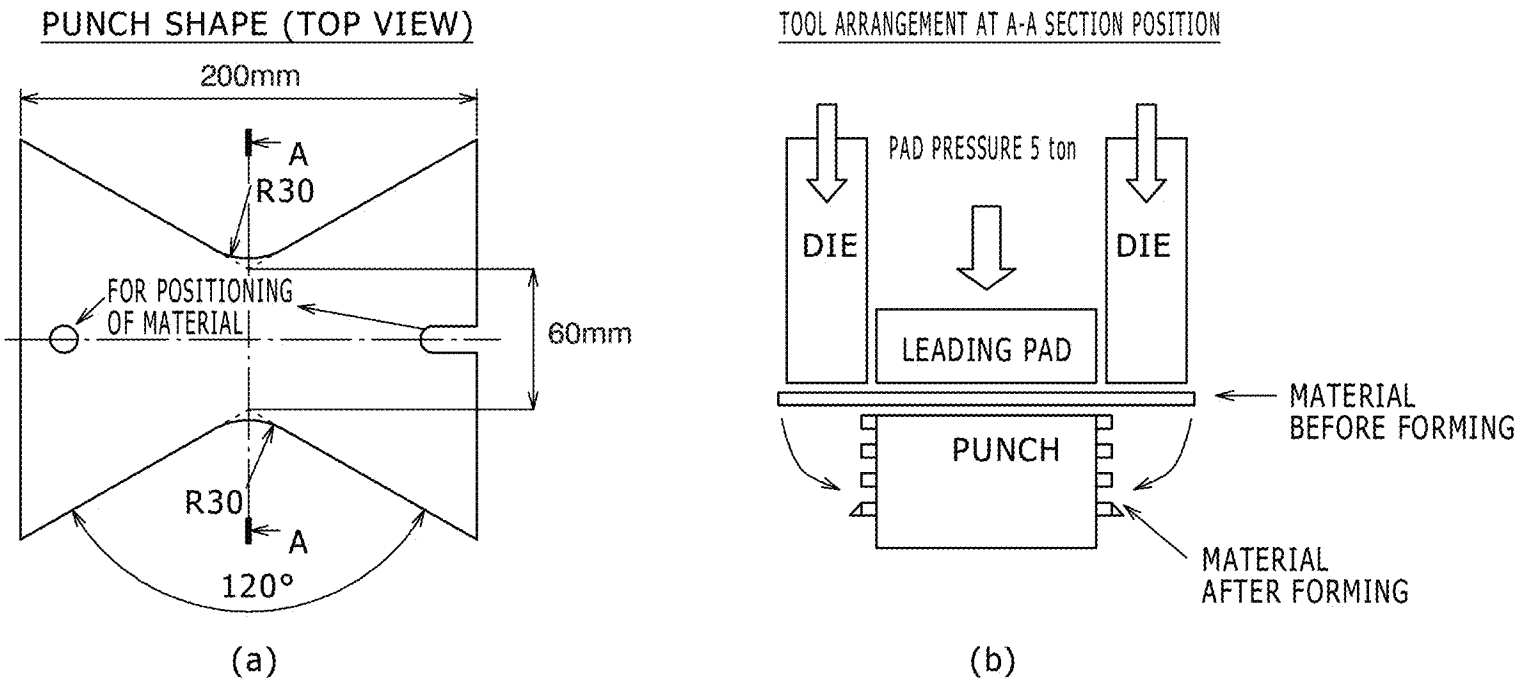
FIG. 33 includes schematic illustrations of a test unit (tool) used for evaluation of stretch flange formability in another Example.
Figure 34:
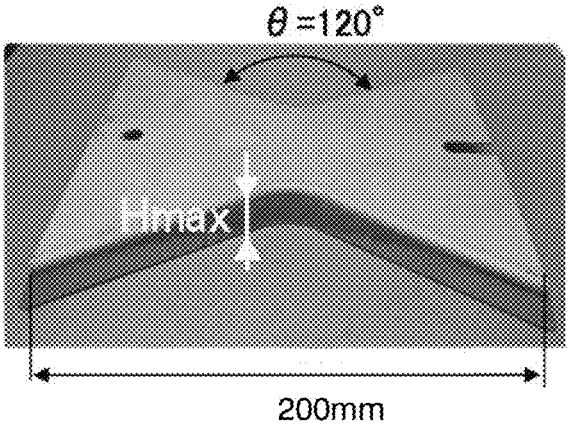
FIG. 34 is a photograph of a stretch-flange-formed component, explaining a position of the largest forming height (Hmax).

The material (1.4 mm thick) of the blank symbol B in Table 1 was heated to 930° C. Then, using a test unit (tool) of FIG. 33(*b*) (a top view of a punch shape is as shown in FIG. 33(*a*)), the material was waited on the tool until temperature reached a predetermined forming start temperature (300° C., 400° C., 500° C., 600° C., or 700° C.). At the predetermined forming start temperature, as illustrated in FIG. 33(*b*), stretch flange forming was performed with a drum tool. As illustrated in FIG. 34, (uncracked) maximum forming height (Hmax) in the stretch flange forming was determined. Table 6 shows results of such determination.

TABLE 6

| | TS590 material Cold press forming | Hot press forming of material B Forming start temperature | | | | |
|---|---|---|---|---|---|---|
| | Room temperature | 700° C. | 600° C. | 500° C. | 400° C. | 300° C. |
| Hmax | 16 mm | 22 mm | 22 mm | 22 mm | 22 mm | 12 mm |

Table 6 teaches the following. Specifically, the maximum forming height is 22 mm in a range of the forming start temperature of the Ms point or higher and less than about 400° C., showing excellent stretch flange forming. This means that excellent stretch flange formability, which is similar to or higher than that in cold press forming of steel in the tensile strength of 590 MPa class, can be secured. As a result, as illustrated in FIG. 6(*b*), a continuous flange is achieved in a joint portion while such a continuous flange is difficult to be achieved by cold press forming.

Example 8

Investigation was made on a relationship between punching temperature and punching quality in punching that was performed during hot press forming as an example of multistage forming.

The material (1.4 mm thick and 100 mm square) of the blank symbol B in Table 1 was heated to 930° C. Then, the material was waited on a tool until temperature reached a predetermined punching temperature (room temperature, 200° C., 300° C., 400° C., 500° C., 600° C., or 700° C.). At the predetermined punching temperature, shearing (punching) was performed with a punch 10 mm in diameter. In addition, a load (shearing load) in such working was measured. A clearance CL between a die and a punch was set to each of 10% and 20% of the thickness. The shearing load was measured at each temperature, and a ratio (%) of such a shearing load to a reference load (a load at similar punching of the material (having a tensile strength of 1518 MPa from Table 2) of the blank symbol D in Table 1) was calculated.

Figure 35:
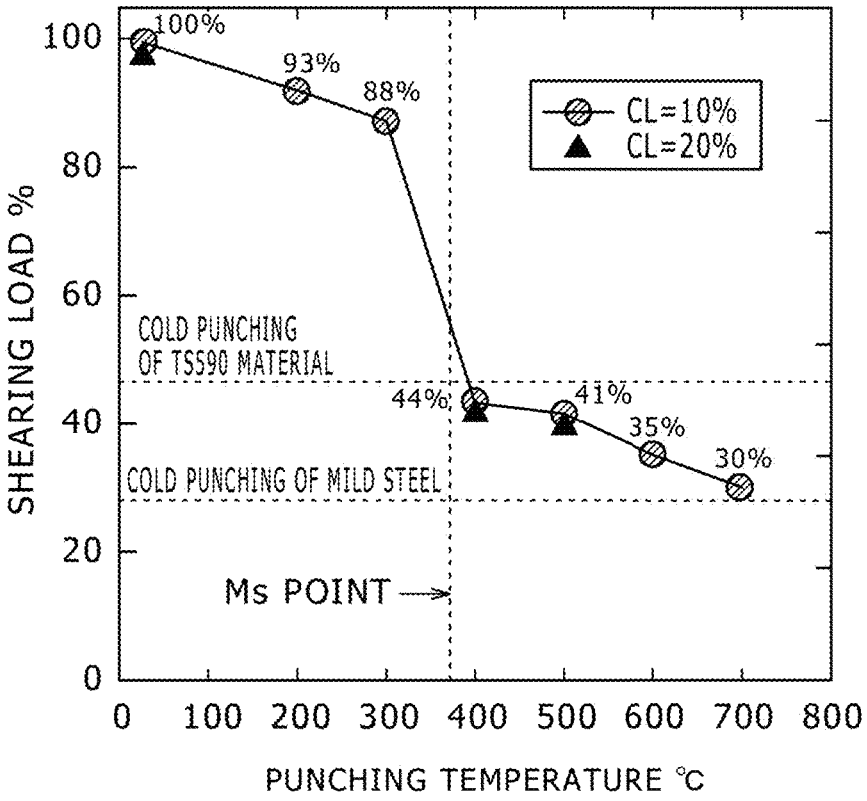
FIG. 35 is a diagram illustrating a relationship between punching temperature and a sharing load (a proportion with respect to a reference load) in another Example.

FIG. 35 illustrates results of such calculation in a form of a relationship between the punching temperature and the ratio with respect to the reference load. FIG. 35 further illustrates a load at cold punching of steel in the tensile strength of 590 MPa class and a load at cold punching of mild steel, such types of steel being generally mass-produced by press forming working.

FIG. 35 reveals that when the punching temperature is the Ms point or higher, punching can be performed at a low load similar to that in cold press forming of a material of which the strength is in a range of a tensile strength of a mild steel level to a tensile strength of 590 MPa class.

DESCRIPTION OF THE REFERENCE NUMERALS AND SIGNS

1 punch
2 die
3 leading pad
4 steel sheet (blank)
5 pin

The invention claimed is:

1. A method of manufacturing a hot-press-formed steel member, the method comprising:

heating a steel sheet comprising

C: 0.10 to 0.30 mass %,
Si: 1.1 to 2.5 mass %,
Si+Al: 1.1 to 3.0 mass % in total,
Mn: 1.5 to 3.0 mass %,
iron, and
inevitable impurities, at a heating temperature of an $Ac_3$ transformation point or higher to form a heated steel sheet;

and subjecting said heated steel sheet to a two-stage cooling process comprising:

a first cooling stage comprising hot press forming the heated steel sheet for plural times with a first hot press forming performed at a start temperature of the heating temperature or lower and a Ms point or higher and a final hot press forming performed at a finish temperature of Ms point or lower and (Ms point−150)° C. or higher to form a hot-press-formed steel member, wherein the hot press forming is performed without spending any time holding at bottom dead center to form a hot-press formed steel member, wherein:

(i) the heated steel sheet is cooled from the heating temperature to (Ms point−150)° C. at an average cooling rate of 3.5° C./sec or more and 4.2° C./sec or less, when the finish temperature in the final hot press forming is equal to (Ms point−150)° C.; or (ii) the heated steel sheet is cooled from the heating temperature to the finish temperature and the hot-press formed steel member is cooled from the finish temperature to (Ms point−150)° C. at an average cooling rate of 3.5° C/sec or more and 4.2° C./sec or less, when the finish temperature in the final hot press forming is Ms point or lower and greater than (Ms point−150)° C.; and a second cooling stage comprising cooling the hot-press formed steel member from the first cooling stage from (Ms point−150)° C. to 40° C. at an average cooling rate of 3° C./sec or less.

2. The manufacturing method according to claim 1, wherein the steel sheet further comprises 1% or less of Cr, excluding 0%.

3. The manufacturing method according to claim 1, wherein the steel sheet further comprises 0.10% or less of Ti, excluding 0%.

4. The manufacturing method according to claim 1, wherein the steel sheet further comprises 0.005% or less of B, excluding 0%.

5. The manufacturing method according to claim 1, wherein the steel sheet further comprises 0.5% or less of Ni and/or Cu, excluding 0%.

6. The manufacturing method according to claim 1, wherein the steel sheet further comprises 1% or less of Mo, excluding 0%.

7. The manufacturing method according to claim 1, wherein the steel sheet further comprises 0.05% or less of Nb, excluding 0%.

8. The manufacturing method according to claim 1, wherein the steel sheet comprises 1.5 mass % or more of Si.

9. The manufacturing method according to claim 1, wherein the steel sheet comprises 1.5 mass % or more of Si and Al in total.

10. The manufacturing method according to claim 1, wherein the heating temperature is at least ($Ac_3$ point+10)° C.

11. The manufacturing method according to claim 1, wherein the heating temperature is at most ($Ac_3$ point+100)° C.

12. The manufacturing method according to claim 1, wherein the start temperature of the first hot press forming is at least (Ms point+30)° C.

13. The manufacturing method according to claim 1, wherein the start temperature of the first hot press forming is at least (Ms point+50)° C.

14. The manufacturing method according to claim 1, wherein the average cooling rate from (Ms point−150)° C. to 40° C. is 2° C./sec or less.

15. The manufacturing method according to claim 1, wherein the average cooling rate from (Ms point−150)° C. to 40° C. is 0.1° C./sec or more.

16. The manufacturing method according to claim 1, wherein the hot-press-formed steel member has a steel microstructure comprising 2 vol % or more of retained austenite.

17. The method according to claim 1, wherein the hot-press-formed steel member is three-dimensionally curved and has a cross-sectional shape that varies in a longitudinal direction.

* * * * *